US012233317B1

(12) United States Patent
Rahman et al.

(10) Patent No.: US 12,233,317 B1
(45) Date of Patent: Feb. 25, 2025

(54) PUTTER HEADS WITH ELECTRONIC DISPLAYS

(71) Applicant: Taylor Made Golf Company, Inc., Carlsbad, CA (US)

(72) Inventors: Brian M. Rahman, Carlsbad, CA (US); Jonathan Dreitlein, Oceanside, CA (US); Todd P. Beach, Encinitas, CA (US); Bret H. Wahl, Escondido, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 330 days.

(21) Appl. No.: 17/878,734

(22) Filed: Aug. 1, 2022

Related U.S. Application Data

(60) Provisional application No. 63/227,889, filed on Jul. 30, 2021.

(51) Int. Cl.
*A63B 53/04* (2015.01)
*A63B 69/36* (2006.01)

(52) U.S. Cl.
CPC ..... *A63B 53/0441* (2020.08); *A63B 53/0487* (2013.01); *A63B 69/3685* (2013.01); *A63B 2220/833* (2013.01); *A63B 2225/50* (2013.01)

(58) Field of Classification Search
None
See application file for complete search history.

(56) References Cited

U.S. PATENT DOCUMENTS

| | | | |
|---|---|---|---|
| 6,929,564 | B2 | 8/2005 | Olsavsky et al. |
| 7,278,926 | B2 | 10/2007 | Frame |
| 7,396,295 | B1 | 7/2008 | Frame et al. |
| 7,438,648 | B2 | 10/2008 | Wahl et al. |
| 7,465,240 | B2 | 12/2008 | Frame |
| 7,594,865 | B2 | 9/2009 | Ines |
| 7,648,425 | B2 | 1/2010 | Wahl et al. |
| 8,066,581 | B2 | 11/2011 | Ines et al. |
| 8,328,654 | B2 | 12/2012 | Demkowski et al. |
| 9,220,960 | B2 | 12/2015 | Schartiger et al. |
| 9,375,619 | B2 | 6/2016 | Beach et al. |
| 9,468,817 | B2 | 10/2016 | Beach et al. |
| 9,522,313 | B2 | 12/2016 | Betts et al. |
| 9,827,479 | B2 | 11/2017 | Demkowski et al. |

(Continued)

FOREIGN PATENT DOCUMENTS

| | | | |
|---|---|---|---|
| CN | 1984698 | A | 6/2007 |
| GB | 2517712 | A | 3/2015 |

(Continued)

OTHER PUBLICATIONS

Adams Golf, "Adams DIXX Putters," https://adamsgolf.wordpress.com/2009/03/14/adams-dixx-putters/, posted Mar. 14, 2009, 3 pages.

(Continued)

*Primary Examiner* — Peter J Iannuzzi
(74) *Attorney, Agent, or Firm* — Klarquist Sparkman, LLP

(57) ABSTRACT

A putter head includes a body portion, an electronic display coupled to the body portion, and a controller coupled to the body portion and in electrical communication with the electronic display. The controller is configured to control the electronic display to display one or more images on the electronic display.

39 Claims, 16 Drawing Sheets

(56) References Cited

U.S. PATENT DOCUMENTS

| | | | | |
|---|---|---|---|---|
| 10,052,530 | B2 | 8/2018 | Greaney et al. | |
| 10,391,369 | B2 | 8/2019 | Greaney et al. | |
| 10,874,928 | B2 | 12/2020 | Demkowski et al. | |
| 11,179,608 | B2 | 11/2021 | Greaney et al. | |
| 2005/0233817 | A1* | 10/2005 | Wiseman, II | A63B 69/362 473/131 |
| 2008/0096683 | A1* | 4/2008 | Salmon | A63B 60/02 473/224 |
| 2010/0248852 | A1 | 9/2010 | Lee | |
| 2010/0255922 | A1* | 10/2010 | Lueders | A63B 53/02 473/223 |
| 2011/0235146 | A1 | 9/2011 | Feil et al. | |
| 2013/0278994 | A1 | 10/2013 | Feil | |
| 2014/0139576 | A1 | 5/2014 | Da Costa et al. | |
| 2014/0361211 | A1 | 12/2014 | Marques et al. | |
| 2016/0375321 | A1 | 12/2016 | Greaney et al. | |
| 2022/0150673 | A1 | 5/2022 | Lord et al. | |
| 2024/0082650 | A1* | 3/2024 | Judge | A63B 53/0487 |

FOREIGN PATENT DOCUMENTS

| | | | |
|---|---|---|---|
| JP | 2008506421 | A | 3/2008 |
| KR | 1020050031862 | A | 4/2005 |
| KR | 631035 | B1 | 10/2006 |
| KR | 2006125447 | A | 12/2006 |
| WO | WO2005/118086 | A1 | 12/2005 |

OTHER PUBLICATIONS

Alan Electronics GmbH, "DiXX Digital Instruction Putter," DiXX—Infinics, product brochure?, printed Jul. 1, 2022, 6 pages.

Alan Electronics—Dixx Putter, "Technische Daten," printed Jul. 1, 2022, 1 page.

Azumo, "Azumo discusses the advantages of Memory-in-Pixie (MIP) displays with Reflective LCDs within medical, industrial and consumer electronics industries," Memory-in-Pixel Is Attracting Attention, ttps://www.azumotech.com/resource-center/memory-in-pixel-is-attracting-attention/, posted May 22, 2020, 5 pages.

Data Modul, "Memory-in-Pixel Technology," Memory-in-Pixel Technology | Data Modul (data-modul.com), printed Jun. 28, 2022, 3 pages.

"Help and Instructions—DiXX Digital Instruction Putter," https://web.archive.org/web/20100304164848/http://www.digitalputter.com.au:80/help.asp, printed Jul. 1, 2022, 3 pages.

"DiXX Lite—Digital Instruction Putter: Now Available in Australia," https://web.archive.org/web/20091030141817/http://www.digitalputter.com.au/, printed Jul. 1, 2022, 2 pages.

Einführung, DiXX Digitaler Ausbildungs-Putter, printed Jul. 1, 2022, 28 pages.

E Ink, "Benefits, Bi-Stable," https://www.eink.com/benefits.html, printed Jul. 1, 2022, 6 pages.

E Ink, "Electronic Ink," https://www.eink.com/electronic-ink.html, printed Jul. 25, 2022, 7 pages.

Etulipa, Technology, "Electro Wetting Display technology (EWD)," https://etulipa.com/electro-wetting-display-technology/, printed Jul. 25, 2022, 3 pages.

Johnson, E. Michael, "How Dustin Johnson is getting dialed in with his putter," How Dustin Johnson is getting dialed in with his putter | Golf News and Tour Information | Golf Digest, posted Jan. 9, 2018, 4 pages.

New Vision Display, "What LCD Modes Mean: Reflective, Transmissive, Transflective," LCD Modes: New Vision Display, https://www.newvisiondisplay.com/LCD-modes, posted Mar. 14, 2017, 8 pages.

Segment LCD, "Custom Segment LCD (7, 14, and 16 Segment Displays)," https://focuslcds.com/segment-LCD/, printed Jul. 22, 2022, 6 pages.

The Sand Trap.com, "Adams Golf Launches DiXX digital Instruction Putter," Adams Golf Launches DiXX Digital Instruction Putter (Bag Drop, Hot Topics)—The Sand Trap, printed Jun. 30, 2022, 7 pages.

Tursky, Andrew, "DJ's new putter has a "T-line," and the reason explains why you need to get fit—GolfWRX," https://www.golfwrx.com/484248/djs-new-putter-has-a-t-line-and-the-reason-explains-exactly-why-you-need-to-get-fit/, posted Jan. 8, 2018, 10 pages.

Ynvisible, Segment Displays, Ultra-Low-Power Segmented E-Paper Displays Tailored to Your Needs, https://www.ynvisible.com/segment-displays, printed Jul. 25, 2022, 8 pages.

YouTube, "2008 PGA Show :: Dixx Blue Computerized Putter," Hooked On Golf Blog channel, published Jan. 21, 2008, 3 pages.

YouTube, "DiXX Lite Digital Instruction Putter," simonfa8 channel, published May 19, 2008, 3 pages.

* cited by examiner

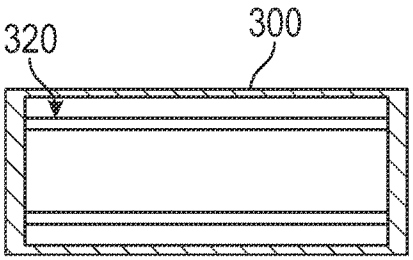
FIG. 7A
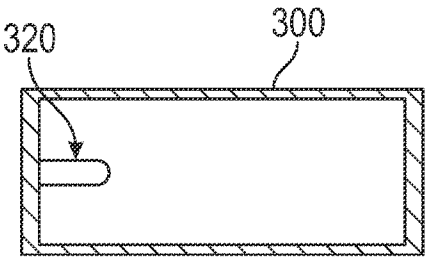
FIG. 7B
FIG. 7C
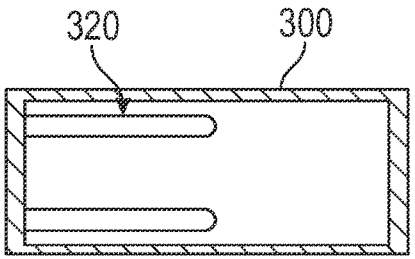
FIG. 7D
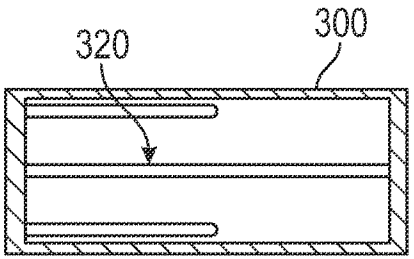
FIG. 7E
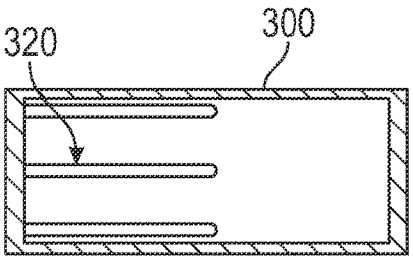
FIG. 7F
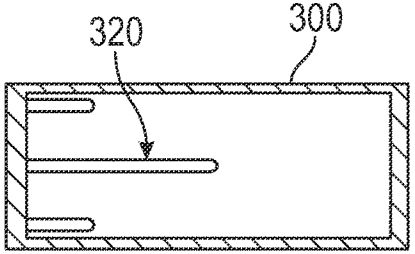
FIG. 7G
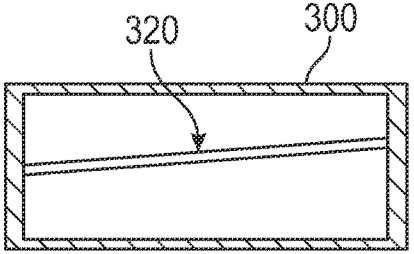
FIG. 7H
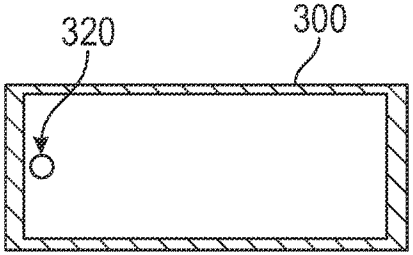
FIG. 7I

PUTTER HEADS WITH ELECTRONIC DISPLAYS

CROSS-REFERENCE TO RELATED APPLICATION

This application claims the benefit of U.S. Provisional Application No. 63/227,889, filed Jul. 30, 2021, which is incorporated herein by reference.

BACKGROUND

Putting in golf requires precision in aiming. However, aiming a putter can be difficult. When getting ready to putt, a golfer may select a spot on the green to aim towards or visualize a line leading to a target and try to roll the ball along that line. However, when actually putting, the direction and pace of the ball when struck by the putter is often different from what is desired. This can be due to various human errors, such as the golfer not holding the putter in proper alignment with the ball and ground, accidental variations in the putter orientation during the swing, hitting the ball not in the center of the putter face, shortcomings in the golfer's eyesight or ability to visualize a direction that is perpendicular to the putter face, other mental or physical errors, etc.

To overcome such problems, some putters have manually added sight lines, which can act as visual cues or alignment indicators for the golfer to line up where the golfer is aiming. The manually added sight lines on the putter can have different lengths and/or shapes (e.g., solid line, dotted line, T-shaped line, circles, etc.). Because of individual differences, a sight line that aids one golfer may not be helpful for another golfer. Even a sight line that works for a golfer in one putting situation may not be ideal for the same golfer in another putting situation. Because the number of sight lines that can be added to a particular putter is limited, a golfer may have to try out and/or select from a number of putters that are otherwise identical except for having different sight lines to determine which style is most helpful for that golfer in each putting situation.

The technology described herein provides an electronic display on a putter head and a controller configured to display one or more sight lines, or other images/information, on the electronic display. The images displayed can be based on position data and/or motion data of the putter measured by one or more sensors coupled to the putter. The sight lines and other information displayed can provide alignment feedback and/or other putting related feedback to the golfer who can adjust and/or correct their swing motion for an improved putting experience.

The controller can also wirelessly communicate with a separate mobile computing device, or other external computing device, which can be used by a golfer to select and/or design specific sight lines to be displayed on the putter head, and/or perform additional analysis of the position and/or motion data and provide instructions and/or recommendations for the golfer. The connected external computing device can also be used to adjust the settings of the display, controller, sensors, or other features of the putter. The technology described herein can also be used to facilitate training of the golfer's swing. Additional advantages of the disclosed technology can be evidenced from the descriptions below and the corresponding drawings filed herewith.

SUMMARY

The present disclosure relates to apparatuses, systems, and methods pertaining to displaying alignment features on an electronic display integrated within a putter head.

Certain aspects of the disclosure concern a putter head. The putter head includes a body and an electronic assembly integrated with the body. The electronic assembly includes an electronic display viewable from above the body and a controller in electrical communication with the electronic display. The controller is configured to select an alignment feature from a plurality of alignment features and display the selected alignment feature on the electronic display. The displayed alignment feature extends from a front part of the electronic display to a rear part of the electronic display.

Certain aspects of the disclosure also concern a system. The system includes a putter head comprising a communication unit and a mobile computing device in wireless communication with the communication unit of the putter head. The putter head further includes a body, an electronic display disposed over a top portion of the body, and a controller in electrical communication with the electronic display and the communication unit. The controller is configured to receive data from the mobile computing device through the communication unit, and display an alignment feature on the electronic display based on the data received from the mobile computing device.

Certain aspects of the disclosure also concern a method. The method includes pairing a putter head with a mobile computing device to establish a wireless communication between the putter head and the mobile computing device, selecting an alignment feature from a user interface of the mobile computing device, transmitting the alignment feature to the putter head; and displaying the alignment feature on an electronic display of the putter head.

The foregoing and other objects, features, and advantages of the disclosed technology will become more apparent from the following detailed description, which proceeds with reference to the accompanying figures.

DETAILED DESCRIPTION

General Considerations

Figure 1A:
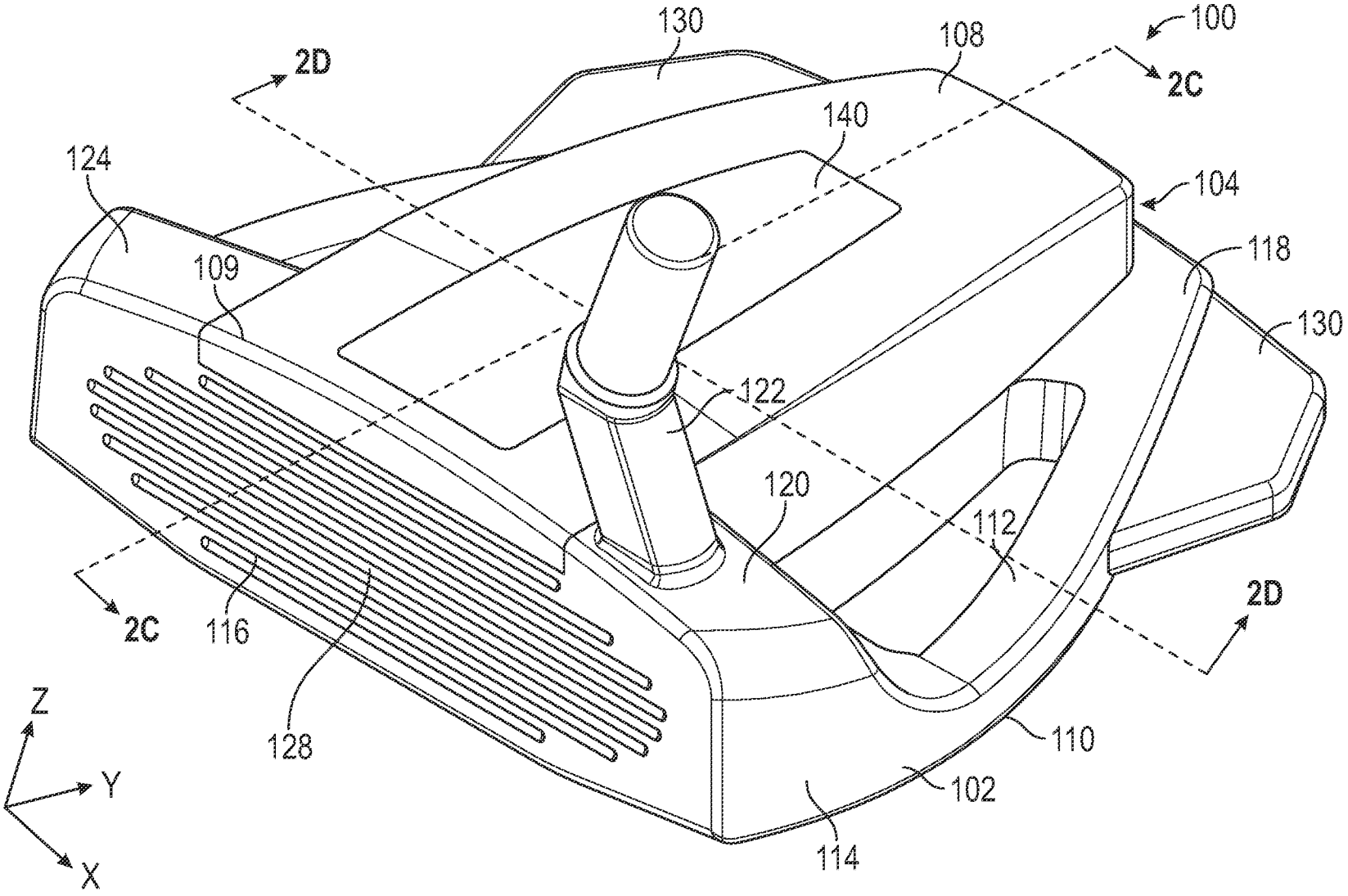
FIG. 1A is a perspective view of a putter head having an electronic display, according to one example.

For purposes of this description, certain aspects, advantages, and novel features of the embodiments of this disclosure are described herein. The described methods, systems, and apparatus should not be construed as limiting in any way. Instead, the present disclosure is directed toward all novel and non-obvious features and aspects of the various disclosed embodiments, alone and in various combinations and sub-combinations with one another. The disclosed methods, systems, and apparatus are not limited to any specific aspect, feature, or combination thereof, nor do the disclosed methods, systems, and apparatus require that any one or more specific advantages be present, or problems be solved.

Features, properties, characteristics, materials, values, ranges, or groups described in conjunction with a particular aspect, embodiment or example of the disclosure are to be understood to be applicable to any other aspect, embodiment or example described herein unless incompatible therewith. All of the features disclosed in this specification (including any accompanying claims, abstract, and drawings), and/or all of the steps of any method or process so disclosed, may be combined in any combination, except combinations where at least some of such features and/or steps are mutually exclusive. The disclosure is not restricted to the details of any foregoing embodiments. The disclosure extends to any novel one, or any novel combination, of the features disclosed in this specification (including any accompanying claims, abstract, and drawings), or to any novel one, or any novel combination, of the steps of any method or process so disclosed.

Although the operations of some of the disclosed methods are described in a particular, sequential order for convenient presentation, this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods, systems, and apparatus can be used in conjunction with other systems, methods, and apparatus.

As used herein, the terms "a," "an," and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A," "B," "C," "A and B," "A and C," "B and C," or "A, B, and C." As used herein, the term "coupled" generally means physically coupled or linked and does not exclude the presence of intermediate elements between the coupled items absent specific contrary language.

Directions and other relative references (e.g., inner, outer, upper, lower, etc.) may be used to facilitate discussion of the drawings and principles herein, but are not intended to be limiting. For example, certain terms may be used such as "inside," "outside,", "top," "down," "interior," "exterior," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" part can become a "lower" part simply by turning the object over. Nevertheless, it is still the same part and the object remains the same. As used herein, "and/or" means "and" or "or," as well as "and" and "or."

Example Putter Components

FIGS. 1A-1D and 2A-2D show an example putter head 100 (or more generally, "club head"), according to one example. Any of the putter heads disclosed herein can be coupled to a putter shaft of any type to form a putter. The herein disclosed technology can be implemented in any type of putter, such as blade style putters, mallet style putters, long putters, belly putters, toe balance putters, face balanced putters, peripheral weighted putters, face insert putters, heel-shafted putters, center-shafted putters, hosel-offset putters, etc.

Although the descriptions and drawings presented herein are mainly associated with putters, any of the technology disclosed herein can analogously be implemented in any other type of golf club, such as a driver, fairway wood, hybrid, rescue, iron, wedge, or other golf club type, to help a golfer orient and align the club head and provide superior golf shots.

As shown, the putter head 100 includes a body 102 and an electronic assembly 104 integrated within the body 102. In certain examples, the putter head 100 can also have a gasket 106 placed over a top of the electronic assembly 104, and a cap 108 disposed over a top of the gasket 106. FIGS. 4A-4D depict various views of the body 102, and FIGS. 5A-5D depict various views of the cap 108.

As depicted in FIGS. 1A-1D and 4A-4D, the body 102 has a sole portion 110 configured to rest on a ground when the putter head 100 is at a normal address position, a top portion 112 opposite to the sole portion 110, a forward or front portion 114 comprising a striking face 116, a rearward portion 118 opposite to the forward portion 114, a heel portion 120 comprising a hosel 122 configured to receive a golf club shaft (not shown), and a toe portion 124 opposite to the heel portion 120. The middle part of the body 102 can have a cavity 126 configured to receive the electronic assembly 104.

Once the electronic assembly 104 is inserted into the cavity 126, a top portion 109 of the electronic assembly 104 can extend overtop an upper portion of the body 102 proximate the striking face 116 (see, e.g., FIG. 1A). In some examples, the top portion 109 of the electronic assembly 104 can form or define an uppermost portion of the putter head 100 (excluding the hosel 122) and/or the uppermost portion of the striking face 116.

The striking face 116 can have a geometric center defining an origin 128 of a club head coordinate system when the putter head 100 is at a normal address position. For example, the club head coordinate system can include a club head X-axis being tangent to the striking face 116 at the origin 128 and parallel to a ground plane. The X-axis can extend in a positive direction from the origin 128 to the heel portion 120 of the putter head. The club head coordinate system can include a club head Y-axis intersecting the origin 128, being parallel to the ground plane and orthogonal to the X-axis. The Y-axis can extend in a positive direction from the origin 128 to the rearward portion 118 of the putter head. The club head coordinate system can include a club head Z-axis intersecting the origin 128, and being orthogonal to both the X-axis and the Y-axis. The Z-axis can extend in a positive direction from the origin 128 to the top portion 112 of the putter head. The heel portion 120 can extend towards, and include, a portion having the hosel 122. The heel portion 120 can extend from a Y-Z plane passing through the origin 128. The toe portion 124 can be defined as the portion of the club head extending from the Y-Z plane in a direction opposite the heel portion 120.

The body 102 can comprise a relatively rigid material, such as stainless steel, aluminum, titanium, or other metals/alloys. The striking face 116 can be a front surface of the body 102 or can be a separate piece that is coupled to the front of the body 102 (e.g., the striking face 116 can be made of a different material than the body 102, such as a polymeric material). The putter head 100 can also include one or more weight members 130 coupled to the body 102. In some cases, the weight members 130 can be detachable and swappable with other weight members of different masses to adjust the mass distribution and inertial properties of the putter head 100.

In some examples, the putter head 100 can also include various other features, such as a sole plate 132 attached to the bottom of the body 102, a crown insert (not shown) attached to the top of the body, etc. The weight members 130, sole plate 132, crown insert, and/or other components can comprise different materials and different densities than the body 102.

Figure 5B:
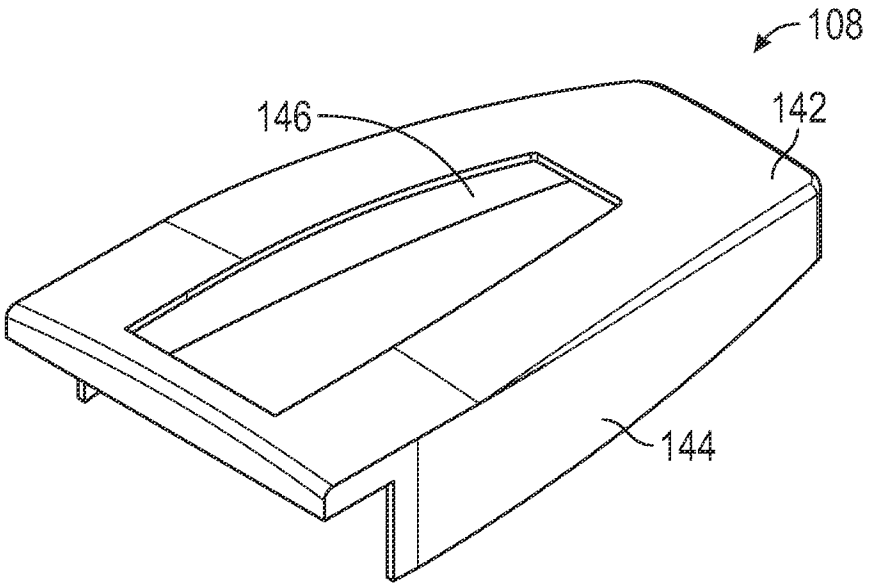
FIG. 5B is a perspective view of the cap depicted in FIG. 5A.
Figure 5D:
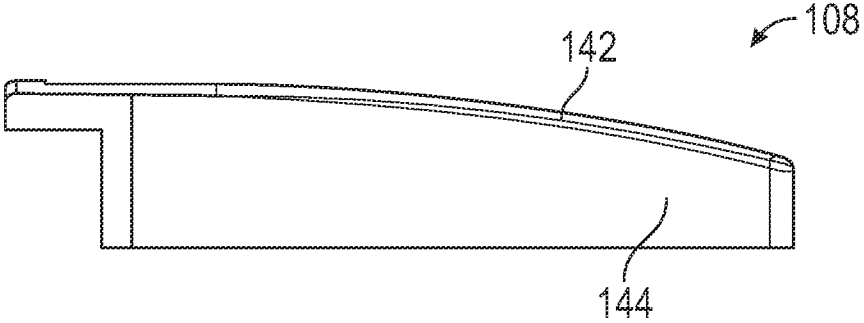
FIG. 5D is a side view of the cap depicted in FIG. 5A.
Figure 5A:
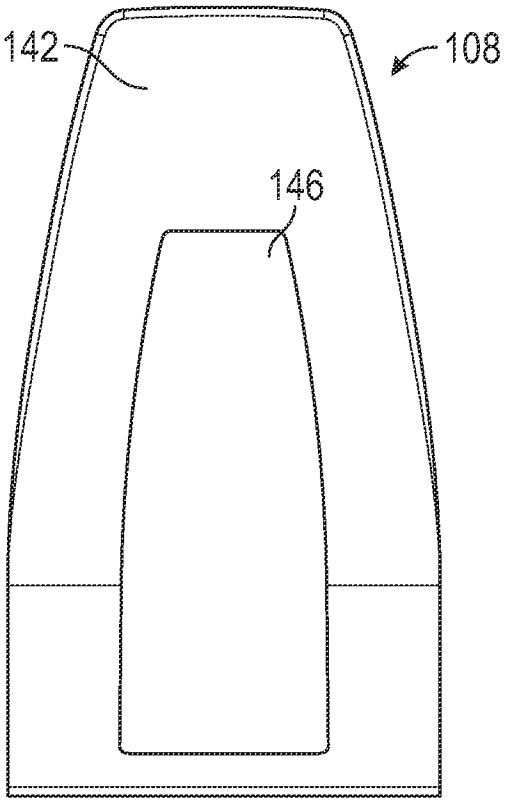
FIG. 5A is a top view of a cap of the putter head of FIG. 1A, according to one example.
Figure 5C:
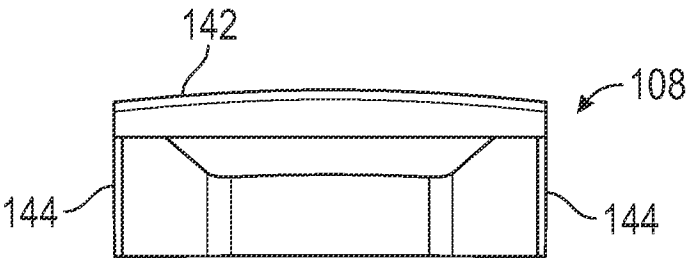
FIG. 5C is a rear view of the cap depicted in FIG. 5A.
Figure 5F:
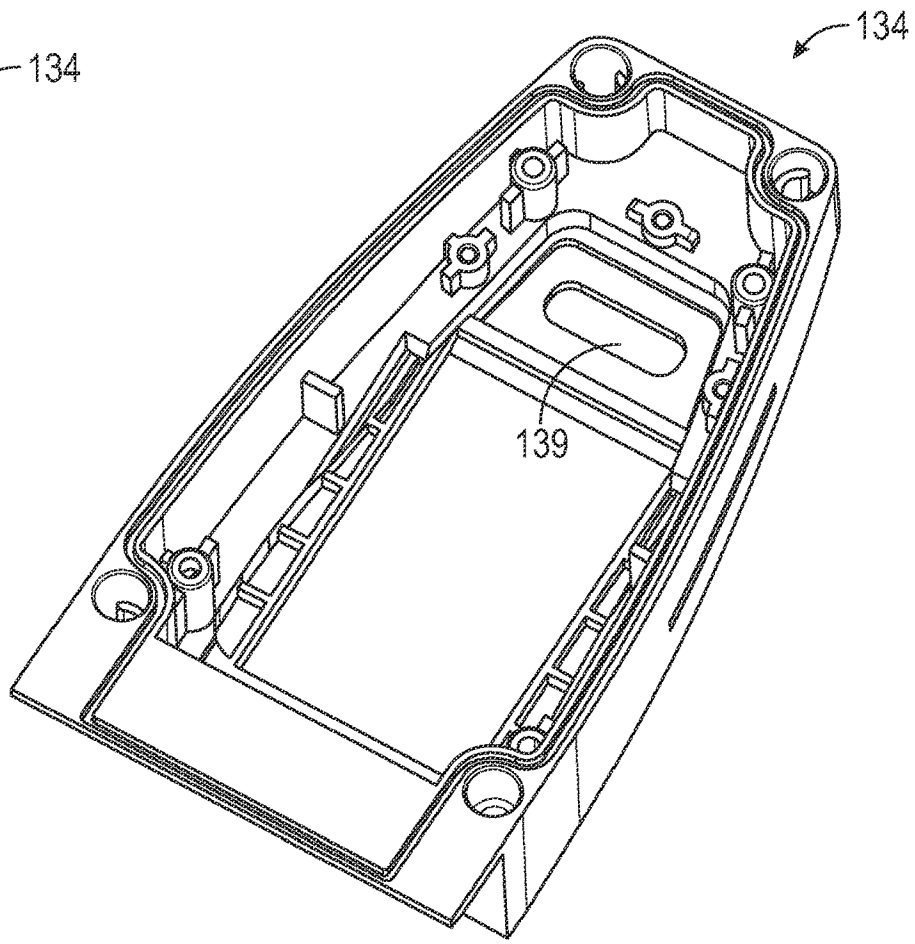
FIG. 5F is a top view of the case depicted in FIG. 5E.
Figure 5E:
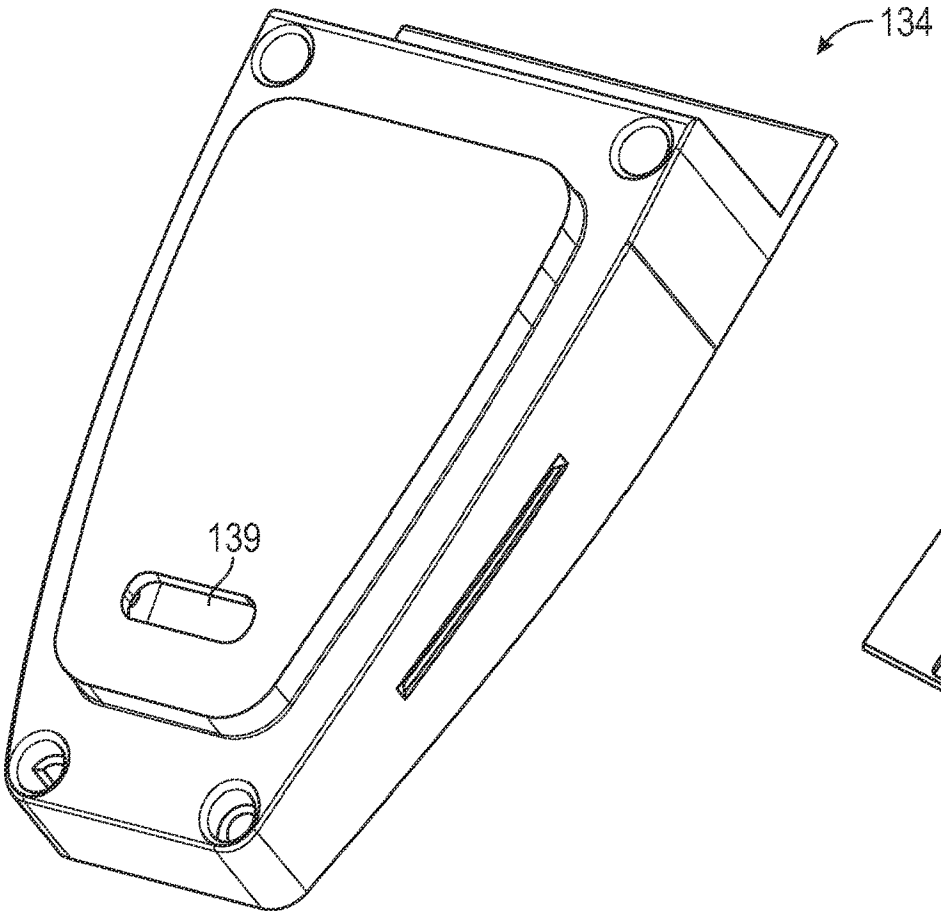
FIG. 5E is a bottom view of a case of the putter head of FIG. 1A.

The electronic assembly 104 can include a housing 134 (which can also be referred to as a "case") and an electronic display 140 disposed on top of the housing 134. In some examples, the housing 134 can comprise a plastic material. In certain examples, the electronic display 140 can received in and secured by (e.g., via fasteners 152) a support bracket 131 (see, e.g., FIGS. 2B-2E), which can be further secured to the housing 134. The shape and size of the cavity 126 can match those of the housing 134 so that the housing 134 can extend into and snug fit within the cavity 126 (see, e.g., FIGS. 2C-2D). Different views of the housing 134 are shown in FIGS. 5E-5F, respectively. In certain examples, the bottom of the housing 134 can have an opening 139 (see, e.g., FIGS. 5E-5F) configured to receive a switch 138, as described further below. The electronic display 140, which is in electronic communication with the controller, can be visible to a user of the putter when the putter head 100 is in the address position.

In some examples, the bottom of housing 134 can define the sole plate 132. For example, the bottom of the cavity 126 can have an opening 115 (see, e.g., FIG. 2A), which is sized and shaped to match the bottom of the housing 134. Thus, when the housing 134 is inserted into the cavity 126, the bottom of the housing 115 completely fills the opening 115 (and can be deemed as a sole plate 132), thus forming a seamless bottom surface of the putter head. Sealing material can be applied to make the interface between the opening 115 and the bottom of the housing 134 waterproof.

In certain examples, a receiving coil 136 (as described further below) can be placed over the bottom of the housing 134 to allow wireless charging of a battery (e.g., 125) retained inside the housing 134. In certain examples, the area of the opening 115 (and the bottom of the housing 134) can range between 400 $mm^2$ and 2500 $mm^2$, or between 900 $mm^2$ and 1800 $mm^2$, to provide a sufficiently large charging surface. In certain examples, the bottom of the housing 134 can be configured to be opened and/or closed so that a user can access or replace (from the bottom of the putter head) the battery located within the housing 134.

In one particular embodiment, the body 102 and the electronic assembly 104 are fixedly coupled together to form a unitary piece such that the electronic assembly 104 is non-removable from the body 102 without breaking the body 102.

The electronic assembly 104 can include various electronic components forming an electronic circuit and enclosed within the housing 134, such as a controller, one or more memory units, one or more sensors, a communication unit, one or more batteries, storage devices, connecting wires, input/output (I/O) ports, etc.

Figure 2A:
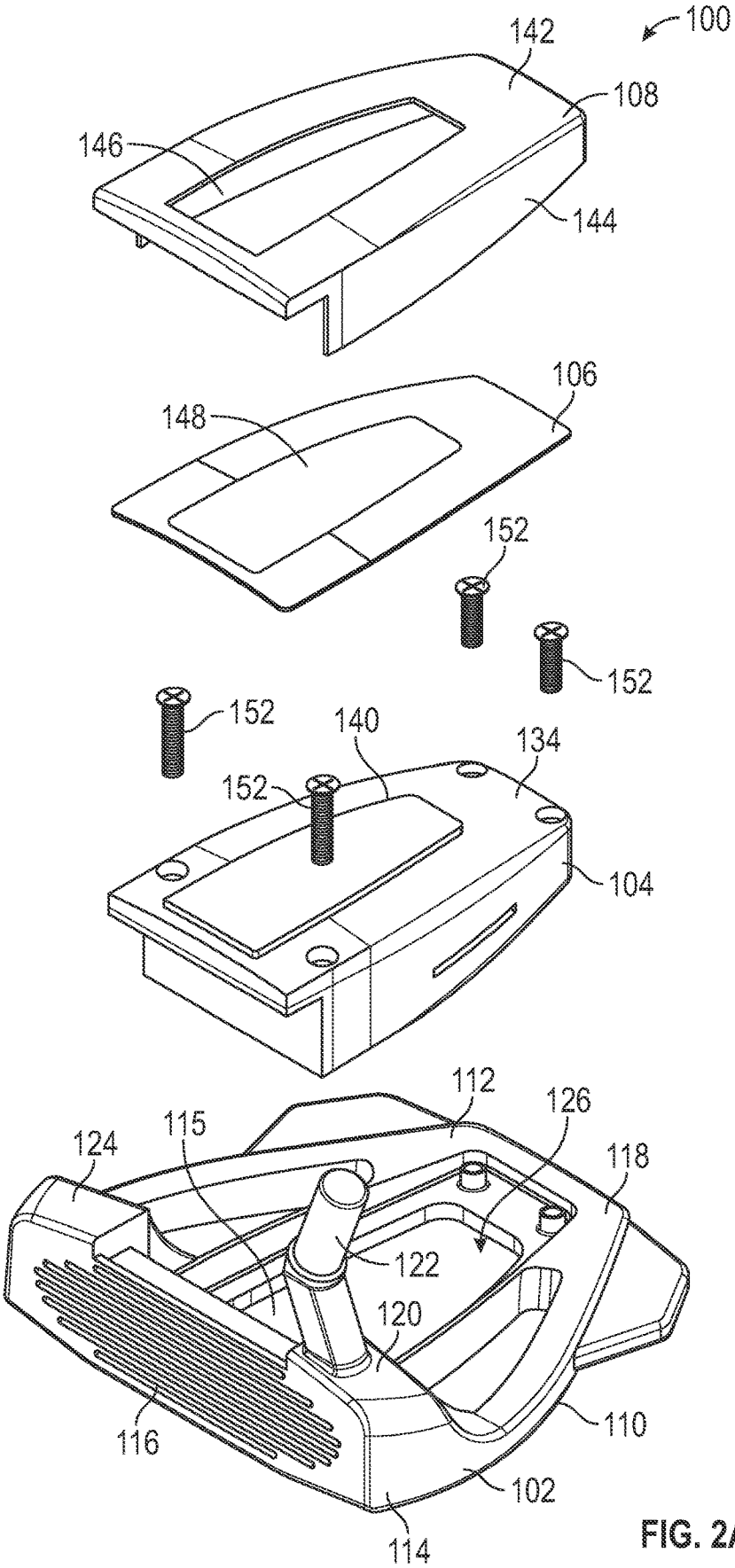
FIG. 2A is an exploded view of selected components of the putter head of FIG. 1A, according to one example.
Figure 2B:
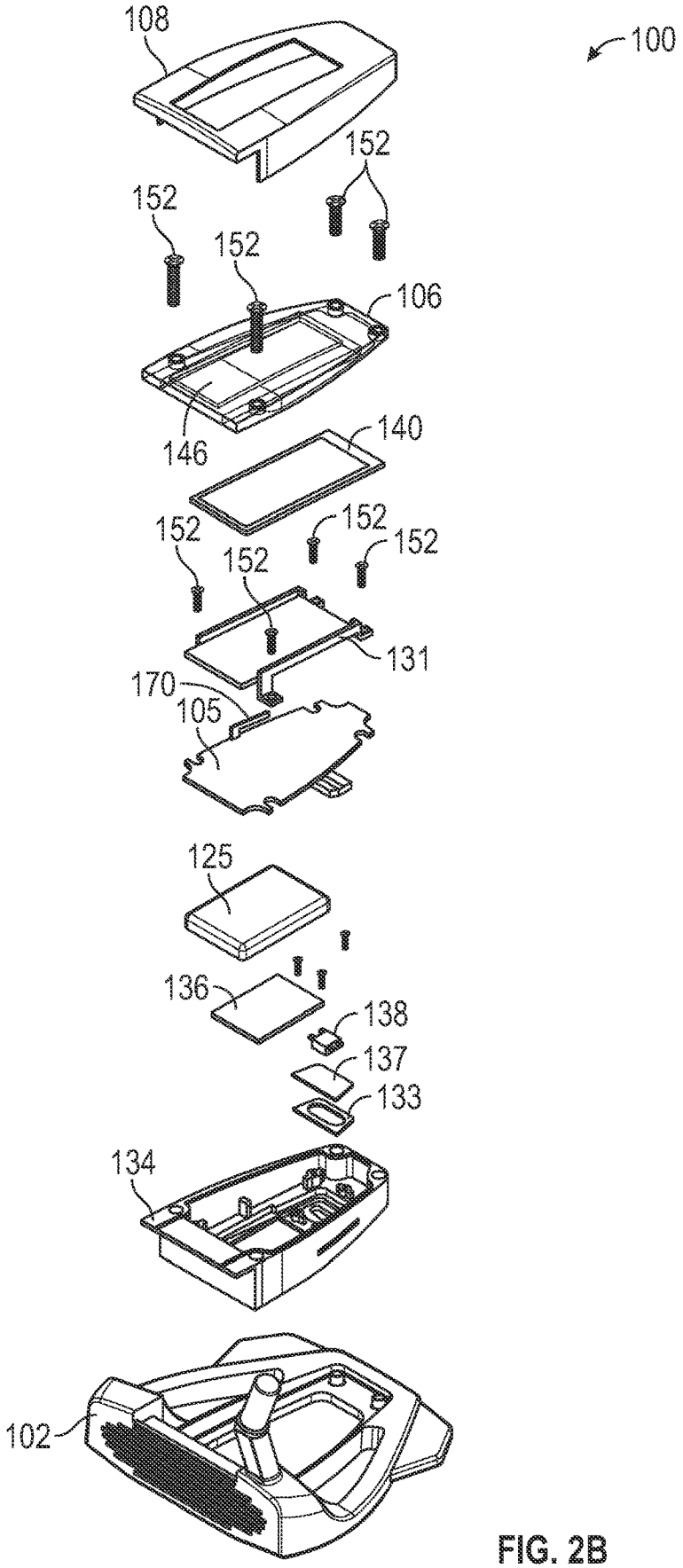
FIG. 2B is another exploded view of some components of the putter head of FIG. 1A, according to one example.
Figure 2C:
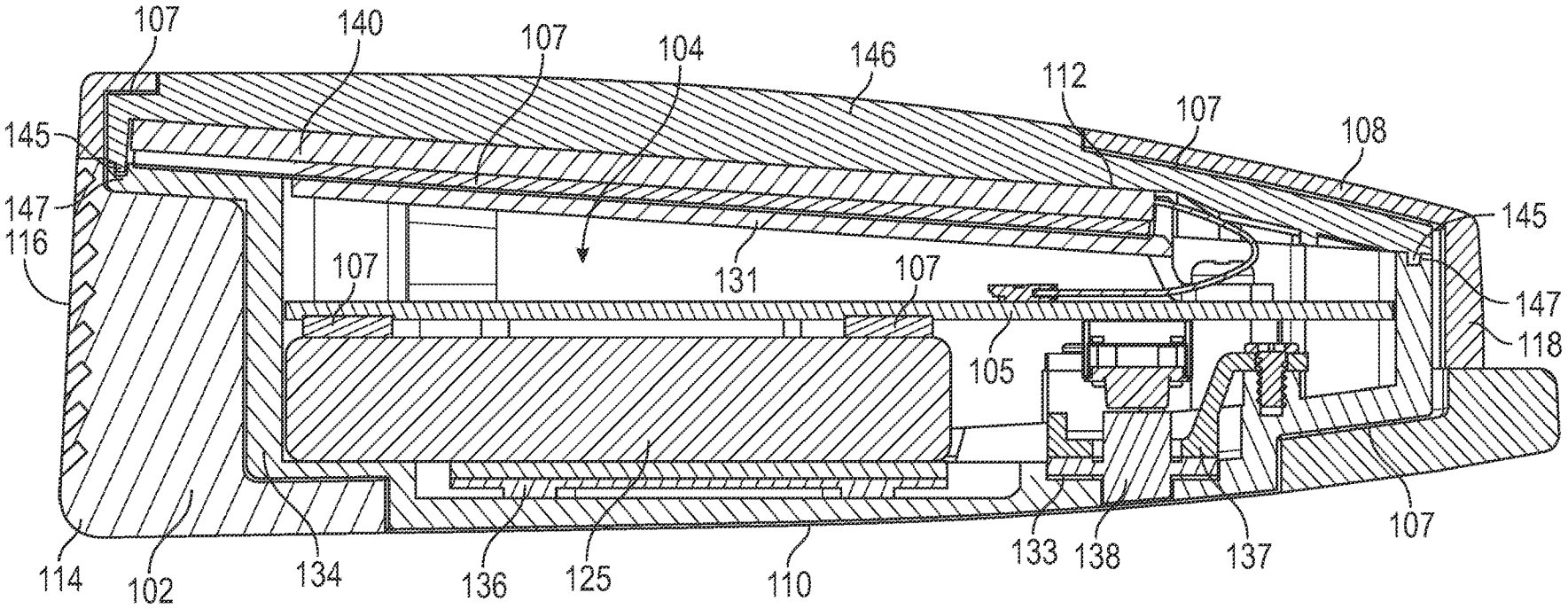
FIG. 2C is a cross-sectional view of the putter head of FIG. 1A taken along 2C-2C.
Figure 2D:
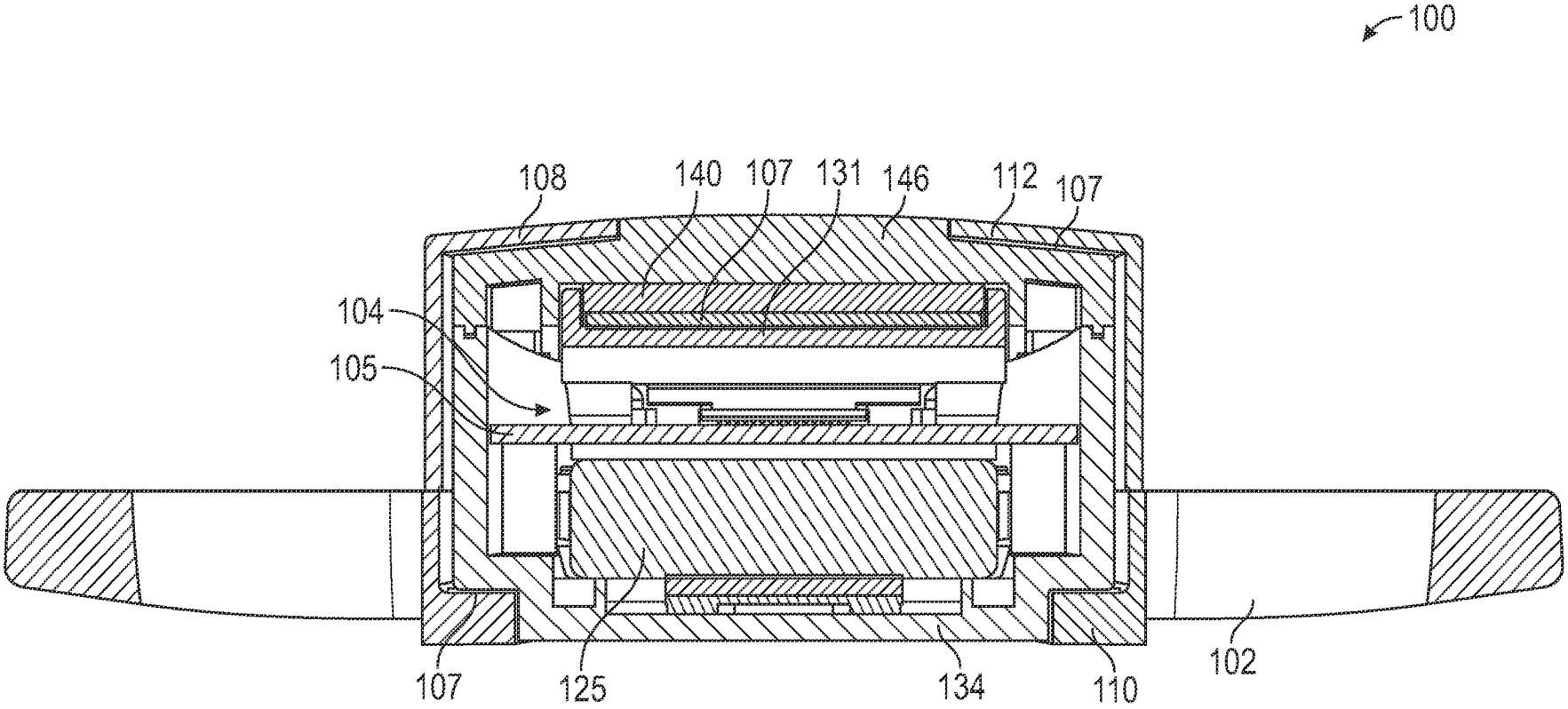
FIG. 2D is a cross-sectional view of the putter head of FIG. 1A taken along 2D-2D.
Figure 2E:
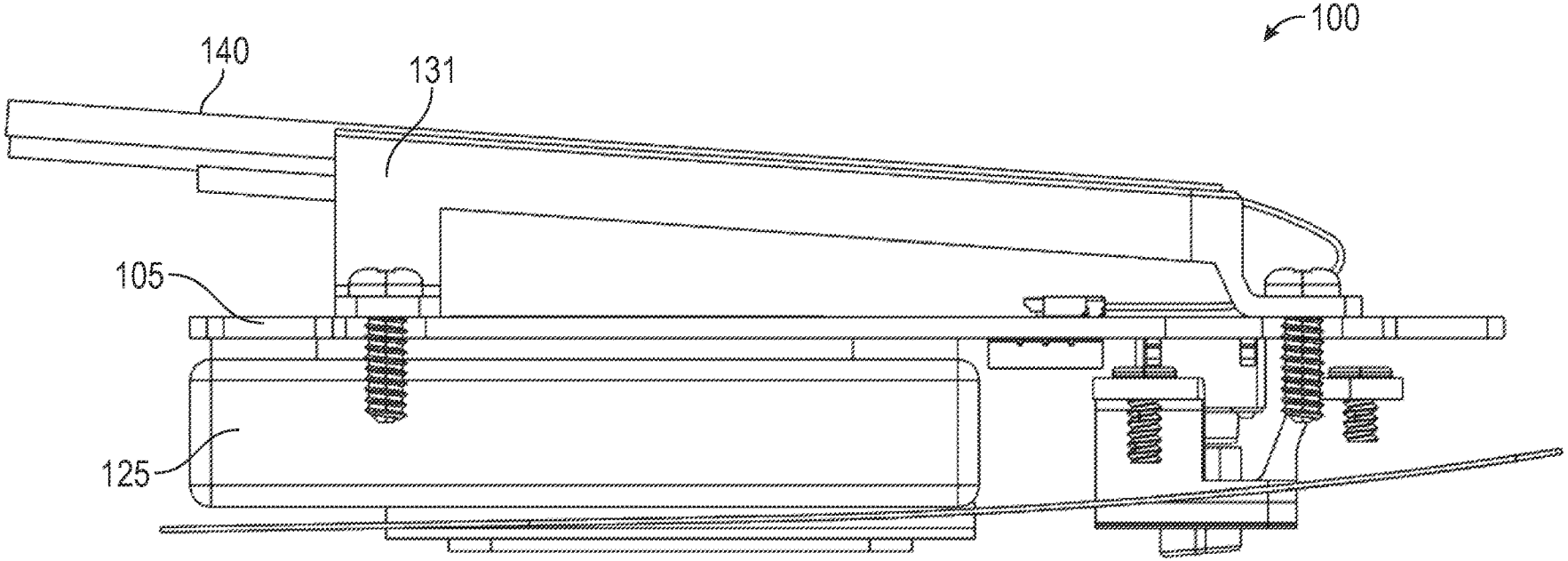
FIG. 2E depicts an example mechanism for anchoring an electronic display to a housing.

As shown in FIG. 2B, at least parts of the electronic circuit can be integrated within a printed circuit board (PCB) 105. In some examples, a battery 125 can be physically separate from (but in electrical connection with) the PCB 105. For example, FIG. 2C shows that the battery 125 can be placed below the PCB 105. In some examples, foams 107 (which can be double-sided adhesives) can be placed between the PCB 105 and the battery 125 to create isolation and/or damp relative movement between the battery 125 and the PCB 105.

The electronic circuit can be configured as a computing system similar to 800 depicted in FIG. 8, which is described more fully below. For example, the controller of the electronic assembly 104 can be one or more processing units 810, 815, the memory units can be memory 820, 825, the one or more sensors can be some of the input devices 850, the electronic display 140 (or 240) can be one of the output devices 860, the communication unit can be one of the communication connections 870, etc.

The controller can be configured to manage and control various aspects of the operation of the electronic circuit, including battery management, on/off status of the electronic display 140 (or 240), control of power levels, sensor measurement, analysis of the measured sensor data, displaying alignment features (e.g., sight lines) or other information on the electronic display 140 (or 240), communication with external computing devices, and the like.

In some examples, the sensors can include at least one inertial measurement unit (IMU). In some examples, the IMU can be a 9-axis sensor including one or more accelerometers, gyroscopes, and magnetometers that measure 3D orientation, 3D velocity, 3D gravitational forces, and/or other properties of the putter head. In some examples, the sensors can include one or more proximity sensor, gesture sensor, motion sensor, impact sensor, pressure/barometer sensor, sound sensor (e.g., microphone, etc.), humidity sensor, light or optical sensor (e.g., camera, etc.), color sensor, or the like. The sensors can be electronically coupled to the controller, battery, and/or other electronic components. The sensors can be enclosed within the housing 134 or located outside the housing 134. For example, the sensors can be positioned at various locations around the putter head 100 as desired, and can be attached to the body or other putter head components.

The battery 125 can be replaceable or permanently installed, can be rechargeable, and can have any form factor. For example, the battery 125 can be a coin cell battery, a nickel cadmium battery, a lithium-ion battery, a nickel metal hydride battery, or other types of batteries. In some examples, the rechargeable battery can be charged through a wired connection (e.g., via a USB port or the like). In some examples, the rechargeable battery can be charged wirelessly, e.g., via magnetic inductive charging. For example, the electronic assembly 104 can include a receiving coil 136 (see, e.g., FIGS. 4A and 2B) connected to the battery 125 and disposed above a bottom cover of the housing 134 (e.g., above the sole plate 132). When aligned with a transmitting coil of an external charging device, the battery 125 can be wirelessly charged through electromagnetic coupling between the receiving coil 136 and the transmitting coil. In certain examples, wireless charging can be controlled by a mobile device, such as a mobile phone. In certain examples, a head cover configured to receive the putter head or an associated golf bag for the putter can be configured as a power source for charging the battery 125, either through a wired connection or wirelessly. In certain examples, the head cover and/or golf bag can have a solar panel configured to provide electric power for charging the battery 125 of the putter head. The battery 125 can be configured to have an extended battery life. For example, a fully charged battery can have an operating duration of at least 4-5 hours, e.g., more than 8 hours, or more desirably can last several days or longer.

In some cases, the battery/batteries can also be utilized as weight members to advantageously distribute the mass of the club head. In certain examples, the battery/batteries can be removable from the putter head so that they can be replaced and/or charged separately. The weight of the battery/batteries can range from about 8 grams to about 35 grams, or from about 10 grams to about 25 grams, or from about 20 grams to about 60 grams. In other examples, one or more coin cell batteries or similar batteries may be used having a mass from about 1.0 to 10.0 grams, preferably between 1.4 grams and 3.6 grams. In one particular embodiment, the battery can be a lithium-ion polymer battery having 3.7V 500 mAh capacity, a size about 29 mm×36 mm×4.75 mm, and a weight about 10.5 gram. The weight of the battery (and/or together with the other components of the electronic circuit, e.g., the electronic display) can be so distributed on the putter head as to achieve a desired center of gravity location and/or desired moment of inertia properties of the putter head. In certain examples, the battery can be configured to have an asymmetric mass distribution over the putter head to provide a greater/more desirable moment of inertia. In one particular example, the battery/batteries can be placed in one or more extended portions, such as in place of weight members 130 projecting from the rear sides of the putter head.

Figure 3:
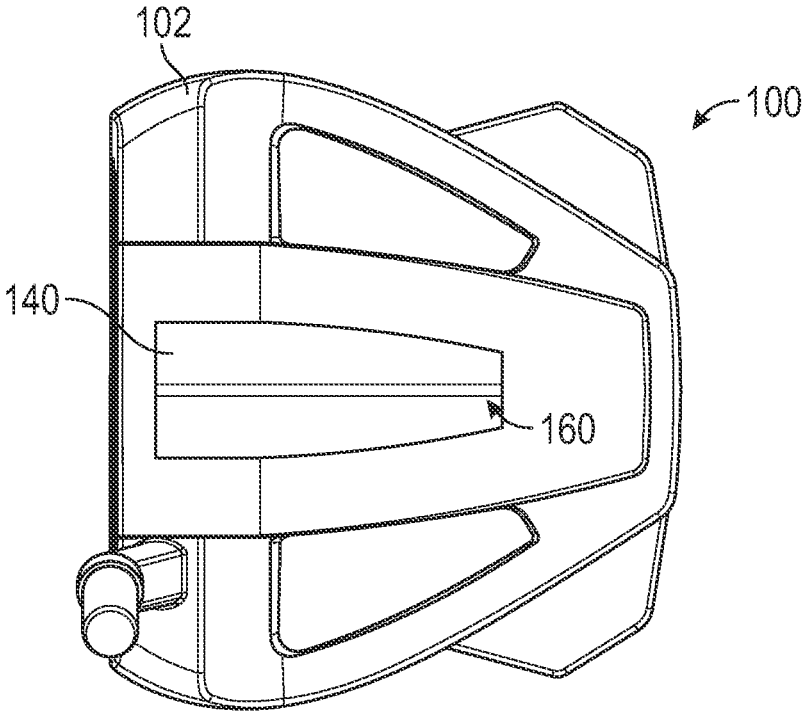
FIG. 3 depicts the putter head of FIG. 1A and a mobile computing device configured to control display on the electronic display of the putter head, according to one example.
Figure 3:
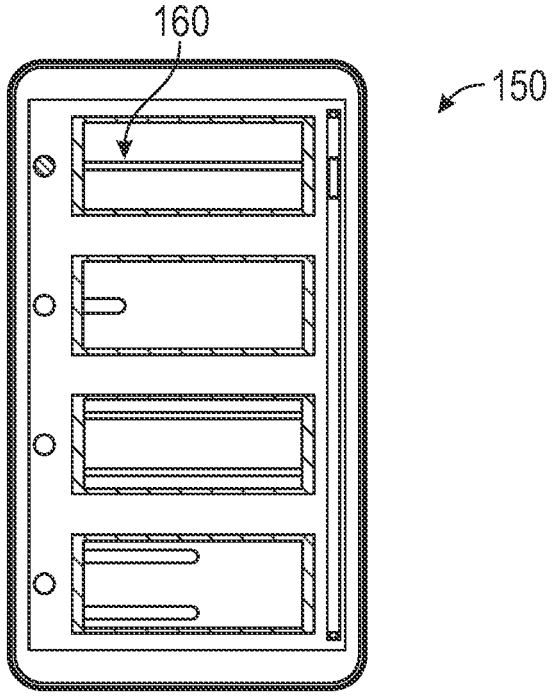

As depicted in FIG. 3, the electronic display 140 can be configured to communicate (e.g., via 870) with a mobile computing device 150 via a wired or a wireless communication protocol. The electronic display 140 can be configured to receive data from the mobile computing device 150. The electronic display 140 can be configured to store the one or more images in the memory (e.g., 820, 825). The one or more images when displayed on the electronic display 140 can include an alignment feature, as described further below. For example, the controller (e.g., 810, 815) can be configured to select an alignment feature 160 from a plurality of alignment features and display the selected alignment feature on the electronic display 140. In some examples, the mobile computing device 150 can control what alignment feature is displayed on the electronic display 140. For example, the controller can be configured to receive data from the mobile computing device 150 through the communication unit (e.g., 870), and display an alignment feature 160 on the electronic display 140 based on the data received from the mobile computing device 150.

In some examples, the electronic display 140 can be fixedly attached to the body 102. In other examples, the electronic display 140 can be removably attached to the body 102. The electronic display 140 can comprise any of various display types. For example, the electronic display 140 can include an emissive display where each pixel in the display screen is an emitter that outputs light when electric current is applied. Example emissive displays include liquid crystal display (LCD), thin-film-transistor (TFT) LCD, light emitting diodes (LED), organic LED (OLED), active-matrix LED (AMOLED), etc. In some examples, the electronic display 140 can operate in a transmissive LCD mode. In some examples, the electronic display 140 can operate in a transflective LCD mode. In both transmissive and transflective LCD modes, the electronic display 140 includes a backlight source (e.g., an array of LEDs) emitting the light which passes through the display screen. In some examples, the electronic display can comprise a reflective display. The reflective display uses ambient light instead a backlight as a light source. Because there is no need for electricity to emit light, power consumption is very low compared with conventional LCDs. In one example, the electronic display 140 can operate in a reflective LCD mode, e.g., by installing a mirror behind the LCD screen, such that ambient light passes through the LCD screen from the front side can be reflected by the mirror back to a viewer. In another example, the reflective display can be a memory-in-pixel (MiP) display based on Low Temperature Poly Silicon (LTPS). In yet another example, the reflective display can be an e-ink or e-paper display based on microencapsulated electrophoretic display technologies.

Other methodologies exist for producing e-ink or e-paper displays including electrowetting and electrochromic. Ynvisble is one company that specializes in electrochromic displays. The Ynvisible Display is an e-paper technology, a so-called Electrochromic Display ("ECD"), based on organic electrochromic polymers. It is categorized as a reflective display—meaning that it reflects ambient light instead of using a backlight. The displays are screen-printed on a plastic substrate, which makes the displays very thin and flexible. The Ynvisble displays may be segmented e-paper displays and offer ultra-low power consumption. For static usage (when the display maintains the same image) the display consumes a maximum of 0.28 μW per $cm^2$ segment area. For dynamic usage, the power consumption depends on the number of display updates per day according to the formula below. See, for example, U.S. Pat. Nos. 9,625,782, 8,907,918, 8,773,747, and US Publication numbers 2014/0361211, 2014/0139576, incorporated by reference herein in their entirety.

Etulipa is a supplier of Electro Wetting Display technology (EWD). Etulipa offers a full-color Electro Wetting Display (EWD) panel that consumes less than 7 $W/m^2$ and runs continuously on a solar panel and battery. Electronicpaper (ePaper) displays like these use the ambient light that falls on the display surface and reflect it back to the eye of the observer, resulting in excellent readability under all conditions. Since reflective displays do not emit light but reflect it they create zero light pollution, are not intrusive, and produce zero emissions. See, for example, US publication numbers 2013/0278994 and 2011/0235146 directed to EWD, both of which are incorporated by reference herein in their entirety.

Figure 4B:
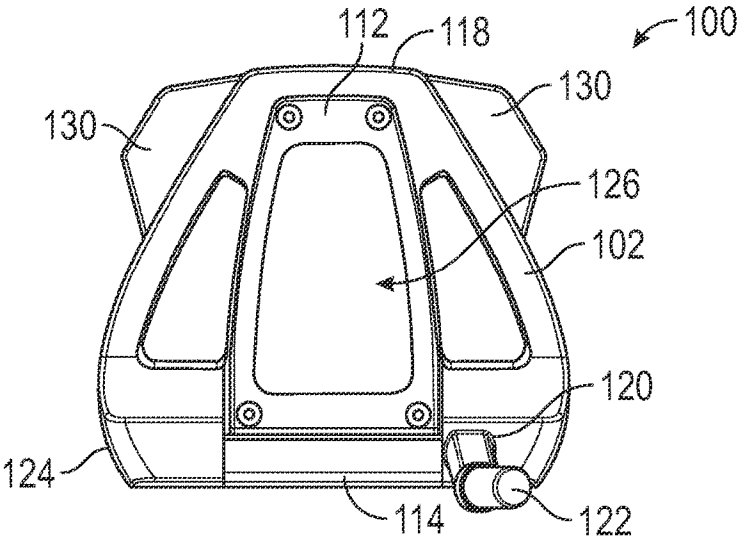
FIG. 4B is a top view of the body depicted in FIG. 4A.
Figure 4D:
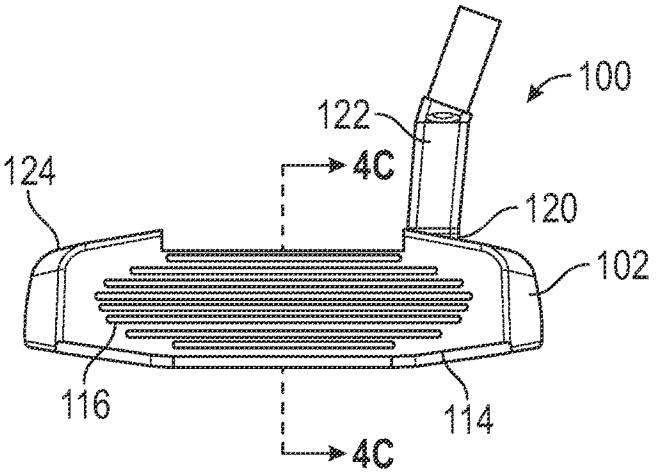
FIG. 4D is a front view of the body depicted in FIG. 4A.
Figure 4A:
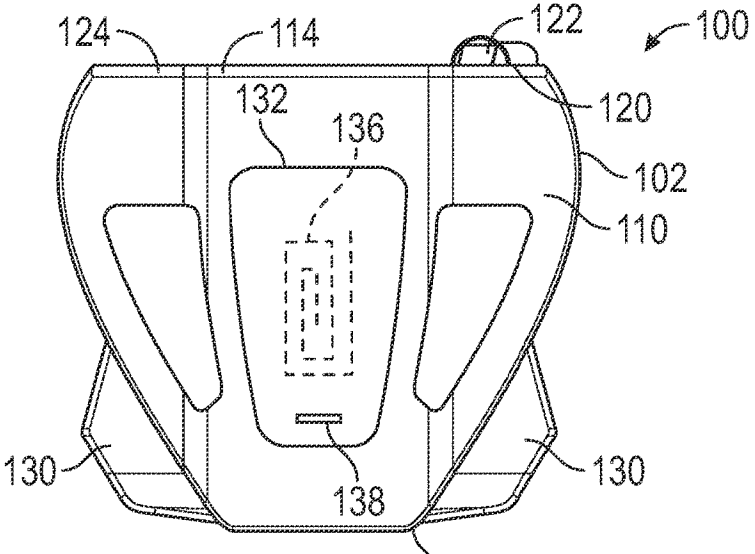
FIG. 4A is a bottom view of a body of the putter head of FIG. 1A, according to one example.
Figure 4C:
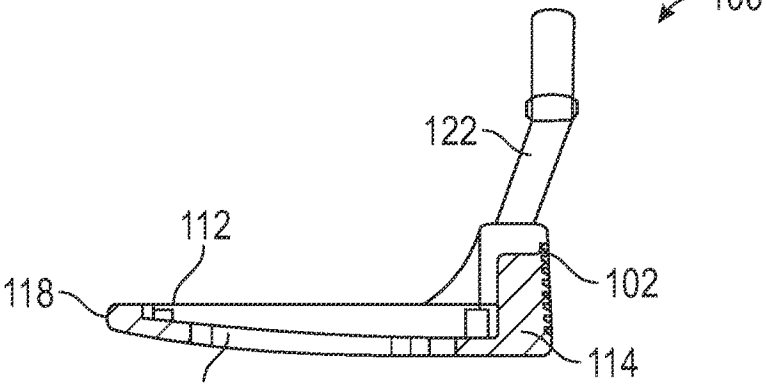
FIG. 4C is a cross-sectional view of the body depicted in FIG. 4A taken along 4C-4C of FIG. 4D.

The putter head 100 can have a switch configured to enable and/or disable electrical operation of the electronic circuit (e.g., to turn on/off the battery and/or the electronic display 140). For example, FIG. 4A shows a switch 138 (e.g., a button) positioned at the bottom of the putter head. Pressing the switch 138 for a predefined duration (e.g., 3 seconds, etc.) can toggle between ON and OFF of the electronic display 140 (and/or other electrical components, e.g., sensors, of the electronic assembly).

In some examples, the switch 138 can extend through the opening 139 located at the bottom of the housing 134. As shown in FIGS. 2B-2C, the switch 138 can be anchored to the housing 134 by a clamping plate 137 and/or with other fastening means (e.g., screws, adhesives, etc.). In some examples, a waterproof and double-sided adhesive member 133 can be attached to the switch 138 to reduce the risk of water/moisture leakage through the opening 139.

Figure 1C:
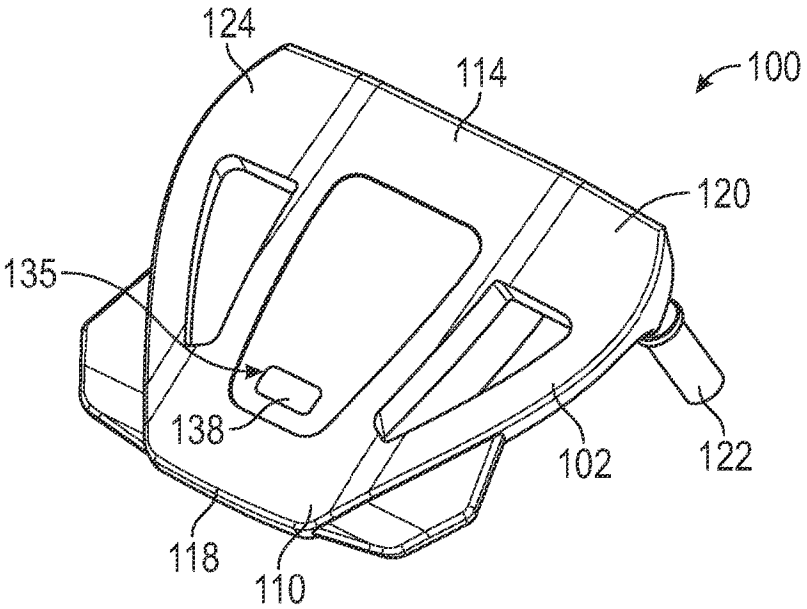
FIG. 1C is a bottom perspective view of the putter head of FIG. 1A.
Figure 1B:
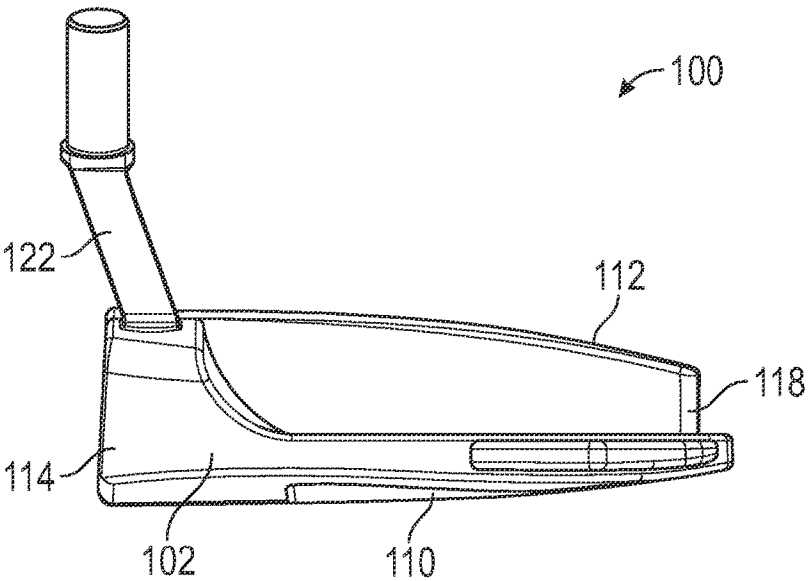
FIG. 1B is a side elevation view of the putter head of FIG. 1A.
Figure 1D:
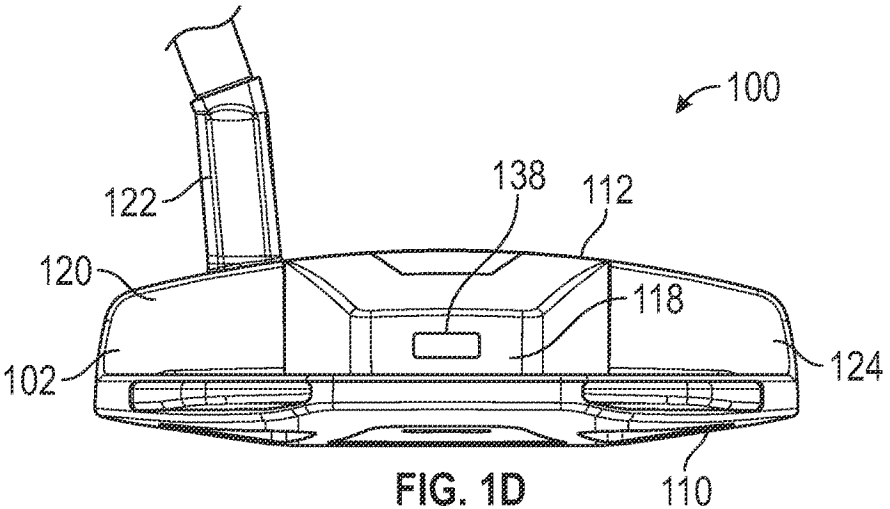
FIG. 1D is a rear view of the putter head of FIG. 1A.

In some examples, the position of the switch 138 is configured to be higher than a ground surface when the putter head 100 is at a normal address position. For example, as depicted in FIG. 1C, the sole portion 110 of the of the putter head can have a slightly recessed region 135 (i.e., recessed upwardly along the positive Z axis). The switch 138 can be positioned within the recessed region 135 so that the switch 138 does not contact the ground when the putter head 100 is at the normal address position. Alternatively, as depicted in FIG. 1D, the switch 138 can be placed over a rear surface (opposite to the striking face 116) of the body 102.

In certain examples, the switch 138 can be multi-functional. As an example, the same switch 138 can be used for pairing between the communication unit of the putter head and the mobile computing device 150. For example, by pressing the switch 138 for a predefined duration (e.g., 5 seconds, etc.) that is different from the duration for turning ON/OFF the electronic circuit, the controller of the putter head can enter into a discovery mode which can be discovered by and paired with the mobile computing device 150. As another example, the same switch 138 can be used to reset, e.g., pressing and holding the switch 138 for a predefined duration (e.g., 10 seconds, etc.) can clear previously paired devices or perform factory reset.

The cap 108 can be placed over a top surface of the putter head 100. As shown in FIGS. 5A-5D, the cap 108 can have a top plate 142 and two side walls 144. The top plate 142 and the side walls 144 can comprise a relatively rigid material, such as stainless steel, aluminum, titanium, other metals/alloys, fiberglass, polycarbonate, other plastics, etc.

The width of the top plate 142, measured along the X-axis, can vary along the Y-axis. For example, the width of the top plate 142 can gradually taper from a front portion of the top plate 142 to a rear portion of the top plate 142. In some examples, the side walls 144 of the cap 108 can be resiliently biased toward each other. Thus, when assembled, the side walls 144 of the cap 108 can press against or clasp respective side walls 144 of the electronic assembly 104, thus helping to secure the electronic assembly 104 in place and preventing it from moving and/or shaking relative to the body 102.

In some examples, a middle portion of the top plate 142 can be covered by a transparent lens 146. In some examples, the lens 146 can be a separate piece from the top plate 142. In some examples, the lens 146 can comprise glass. In some examples, the lens 146 can comprise polycarbonate. In some examples, the lens 146 can have a curved top surface in heel-to-toe direction (e.g., along X-axis) and/or in front-to-back direction (e.g., along the Y-axis). The lens 146 can cover at least a portion of the electronic display 140, thus defining a window through which a user can view the displayed images on the electronic display 140. In some examples, particularly when the electronic display is of the emissive display type, the lens 146 can comprise an anti-glare coating and/or an anti-reflective coating configured to decrease the amount of reflective light from the lens 146, thus improving readability of the electronic display 140 under direct sunlight. In some examples, the lens 146 can include an anti-fingerprint coating.

The electronic assembly 104 can be fully sealed so that it is watertight or waterproof. For example, the putter head 100 can include sealing members/materials at selected portions of the metal frame and the sole plate to hermetically encapsulate the electronic assembly 104. The sealing members/materials can comprise silicone rubber, gaskets, adhesives, foams, and/or other elements. As just one example, FIG. 2A shows a gasket 106 placed underneath the cap 108 and over a top surface of the electronic assembly 104, including the electronic display 140. The gasket 106 can follow the shape of the top plate 142 of the cap 108 and have an opening 148 matching that of the lens 146. The top surface the gasket 106 can have an adhesive configured to glue the gasket 106 to the top plate 142 of the cap. The bottom surface of the gasket 106 can also have an adhesive configured to glue the gasket 106 to the top surface of the electronic assembly 104. Optionally, one or more fasteners 152 can be used to further secure the gasket 106 to the electronic assembly 104. Similarly, sealing member(s) can be placed over a top surface, a bottom surface, and/or sides of the electronic assembly 104 (e.g., via adhesive, welding, and/or fasteners) to further insulate and/or protect the electronic assembly 104 from external moisture. For example, FIG. 2C shows adhesive foams 107 (which can be double sided) placed on selected top and bottom areas of the electronics assembly 104.

In certain examples, selected portions of the putter head 100 (e.g., the body 102, the top plate 142, the electronic display 140, the side walls of the electronic assembly 104, etc.) can comprise a high thermal conductivity material (e.g., aluminum, copper, or the like) so that they can be configured to act as a heat sink to facilitate dissipation of heat generated by the battery, controller, electronic display, or other parts of the electronic assembly 104.

In some examples, the putter head 100 can further include insulating material within the putter head 100 and/or attached to the exterior of the putter head 100. Such insulating material can comprise foams, fabrics, deformable materials such as polymeric materials, water repellent materials, shock resistant material, heat-insulating material, anti-static materials, etc. Such insulating materials can be located within the body 102, such as around the electronic assembly 104 to protect the electronic assembly 104 from environmental impact.

In some examples, the putter head 100 can include a light output (not shown), such as a laser pointer, projector, or other components, for outputting a light-based indicator away from the putter. For example, such an indicator can comprise a light beam that projects in the direction that club head is currently facing (e.g., perpendicular from the center of the striking face 116). In some examples, a line or other symbols can be projected across the green in front of the putter head 100 indicating the direction perpendicular from the striking face 116. Such visual projections can help a golfer better aim their putts.

In some examples, the putter head 100 can comprise a gyroscopic device or other active device that automatically biases the putter head toward a certain orientation (e.g., a level positioned with a predetermined lie and loft angles).

Figure 6A:
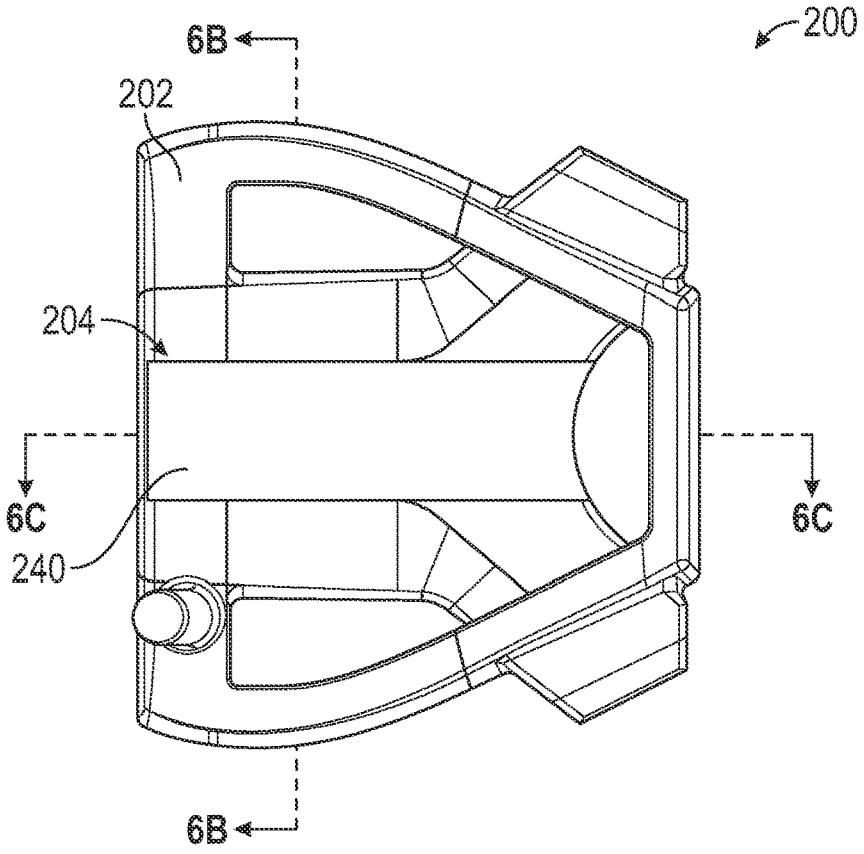
FIG. 6A is a top view of another putter head having an electronic display, according to another example.
Figure 6B:
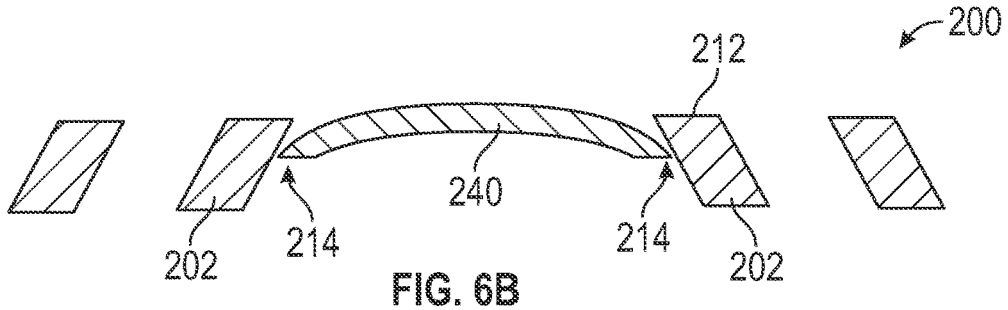
FIG. 6B is a cross-sectional view of the putter head of FIG. 6A taking along 6B-6B.
Figure 6C:
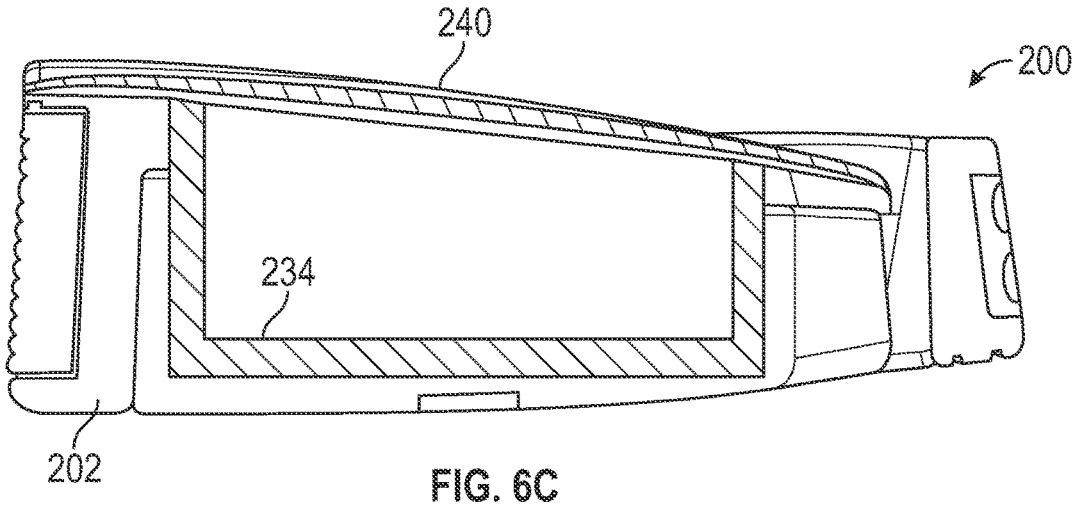
FIG. 6C is a cross-sectional view of the putter head of FIG. 6A taking along 6C-6C.

FIGS. 6A-6C depicts a putter head 200, according to another example. Similarly, the putter head 200 has a body 202 and an electronic assembly 204 integrated with the body 202. The electronic assembly 204 has a housing 234 configured to enclose components of an electronic circuit. An electronic display 240 can be disposed over a top surface of the housing 234. The electronic display 240 can curve from a toe portion to a heel portion of the putter head 200. Additionally, the electronic display 240 can curve from a forward portion to a rearward portion of the putter head 200. Thus, any water falling on top of the electronic display would tend to run off either from sides, front, and/or rear edges of the electronic display 240. In some examples, at least a portion of the electronic display 240 can extend below a top surface 212 of the body 202 and is spaced apart from the body 202 so as to create one or more gaps 214 underneath the top surface 212 and extending between the electronic display 240 and the body 202. Such gap or gaps 214 can facilitate water drainage and prevent water pooling on top of the electronic display 240. In some examples, the electronic display 240 can have a screen protector made of glass, polycarbonate, or the like. In some examples, the electronic display 240 can have an anti-glare coating, anti-reflective coating, and/or anti-fingerprint coating.

Example Weight Parameters

In certain examples, a total weight of the putter head 100 (without counter balancing) can have a range from 335 g to 435 g, or from 345 g to 435 g, or from 350 g to 410 g, or from 365 g to 405 g, or from 355 g to 375 g, all inclusive. With counter balancing, an additional between 50-70 g can be added to the total weight of the putter head 100.

In some examples, the weight of the electronic assembly 104 can be between 2% and 20%, or between 3% and 15%, or between 5% and 12%, or between 10% and 16%, or less than 10% of the total weight of the putter head 100 (including the hosel 122 and excluding the shaft).

In some examples, the total weight of the electronic assembly 104 (including the PCB 105 and fasteners 152), the lens 146, the electronic display 140, and the support bracket 131 can range from 40 g to 60 g, or from 45 g to 55 g, or from 48 g to 52 g, all inclusive. Without the lens 146 and the fasteners, such total weight can range from 30 g to 50 g, or from 35 g to 45 g, or from 38 g to 42 g, all inclusive.

In some examples, the combined weight of the electronic display 140, the support bracket 131, and PCB 105 can range from about 10 g to 40 g, or from 20 g to 30 g, all inclusive. In some examples, the combined weight of the electronic display 140 and the support bracket 131 can range from 4 g to 12 g, or from 6 g and 10 g, all inclusive.

In some examples, the weight of the housing 134 can range from 5 g to 25 g, or from 10 g to 15 g, all inclusive.

In some examples, the weight of the lens 146 can range from 4 g to 12 g, or from 6 g to 10 g, all inclusive.

Example Putter Head Moment of Inertia (MOI)

Forgiveness on a putter shot can be maximized by configuring the putter head such that a center of gravity ("CG") of the putter head is optimally located and a moment of inertia ("MOI") of the putter head is maximized. CG and MOI can also critically affect a putter head's performance, such as launch angle and flight trajectory on impact with a golf ball, among other characteristics.

Generally, the CG of a putter head 100 is the average location of the weight of the putter head or the point at which the entire weight of the putter head may be considered as concentrated so that if supported at this point the putter head would remain in equilibrium in any position.

In terms of the MOI of the putter head (i.e., a resistance to twisting) it is typically measured about each of the three main axes of a putter head with the CG as the origin of the coordinate system. These three axes generally match the X-Y-Z coordinate system described above except for moving the origin of the coordinate system from the geometric center 128 of the striking face 116 to the CG of the putter head. The shifted coordinate system (where the CG is the origin) defines the CG X-axis, CG Y-axis, and CG Z-axis, which are respectively parallel to the X-axis, Y-axis, and Z-axis shown in FIG. 1A.

Specifically, a putter head has a moment of inertia about the vertical CG Z-axis ("Izz"), a moment of inertia about the heel-to-toe CG X-axis ("Ixx"), and a moment of inertia about the front-to-back CG Y-axis ("Iyy"). Typically, however, the MOI about the CG Z-axis (Izz) and the CG X-axis (Ixx) is more relevant to putter club head forgiveness. Example formulas for calculating the MOIs are described in U.S. patent application Ser. No. 17/696,664, which is incorporated herein in its entirety.

In certain examples, without counter balancing, the MOI about the CG X-axis ("Ixx") can range between 500-4000 $g \cdot cm^2$, and the MOI about the CG Z-axis ("Izz") can range between 3000-6000 $g \cdot cm^2$. In one specific example, with a 385 g putter head, Ixx can be between 2800-2860 $g \cdot cm^2$ and Izz can be between 5000-5050 $g \cdot cm^2$. With counter balancing, Ixx and Izz can be even higher.

Example Displays

Any features described herein with reference to the electronic display 140 are also applicable to other electronic displays (e.g., 240, 300) described further below.

The electronic display 140 can be emissive or reflective. For example, the electronic display can be any one of the following screen types: LCD, TFT LCD, LED, OLED, AMOLED, e-paper display, e-ink display, memory-in-pixel (MIP), etc.

The electronic display 140 can be substantially flat or can have a curvature. In some examples, the electronic display can be covered by a curved cover that follows a contour of the top surface of the putter head. In some examples, the electronic display itself can be curved (e.g., using a flexible screen material) about multiple axes, e.g., with a spherical or circular curvature in heal-to-toe and/or front-to-back directions.

In some examples, the electronic display 140 (and/or the lens 146) can have a sloped surface along the front-to-back direction (Y-axis) so as to facilitate water runoff and avoid water pooling. For example, a first elevation at a forward portion of the electronic display 140 (and/or the lens 146) can be greater than a second elevation at a rearward portion of the electronic display as measured relative to a ground plane when the putter head is in a normal address position.

In some examples, the electronic display 140 can be covered by a screen protective layer, an anti-glare layer, an anti-reflective layer, an anti-fingerprint layer, or any combination thereof.

In some examples, through a controller, the electronic display 140 can have an auto-dim feature. For example, the electronic display be configured to automatically adjust the brightness of the display (e.g., decreasing the brightness in dusk, dawn, shade, or low light condition, increasing the brightness in the sun, etc.). In some examples, to provide good readability in a bright environment and/or reduce power consumption, the electronic display can be configured to operate in a reflective LCD mode or transflective LCD mode. In some examples, to reduce power consumption and/or sunlight readability, the electronic display can be configured as a MIP display where each pixel is individually addressable. In some examples, the electronic display can be an e-paper or e-ink type of display.

In some examples, the electronic display 140 can be configured as a segmented display, where a plurality of pre-configured line segments can be independently turned ON or OFF. Illumination of individual line segments can be based on a limited number of colors (e.g., 2, 3, 4, etc.). A selected number of dots or line segments forming a predefined shape or pattern (e.g., a straight line, a curved or angled line, a cross, one or more squares, one or more triangles, one or more circles, one or more polygons, e.g., hexagon or octagon, etc.) can be simultaneously illuminated to display the predefined shape or pattern. In addition to common geometric shapes, the predefined shape could be a logo or one or more icons representing a shape such as a heart, power button (partial circle with a line bisecting the top of the circle), various emojis, a low battery icon or fully charged battery icon, or a temperature warning icon such as a thermometer for indicating excessive heat. Icons, dots, line segments, and other shapes may be replicated at different positions, allowing for selectively moving the icon, dots, line segments, or other shapes along a heel to toe direction and/or along a front to back direction of the electronic display. Additionally, other sight lines or alignment features disclosed throughout may be selectively movable along a heel to toe direction and/or along a front to back direction of the electronic display using a mobile device to control the movement.

Because only a limited number of individually addressable line segments need to be turned ON or OFF, using the segmented display may have certain benefits, such as a lower cost to customize and more energy efficient compared to matrix-based displays which rely on individual pixels to form an image or a shape pattern, which may cause pixelated lines in certain circumstances. In contrast, the segmented display can create crisp images and straight lines without the need for high matrix resolution. For example, a segmented display may have predefined shapes (angled lines, circles, curved features, etc.) that when turned on appear crisp to the eye. Typically, if you have a low-resolution matrix-based display and try to have an angled line or another shape that does not directly utilize the square nature of those pixels, i.e., a circle, you are limited by the pixels themselves as to the clarity of your image. In other words, a segmented display may offer more crisp shapes that would only be achievable with a much higher resolution matrix display and much higher power consumption matrix display. Additionally, the segmented display can be used with or without a backlight and reduce power dissipation within the electronic system, may require only minimal componentry, do not require drivers, is easy to produce, and result in robust field operation.

In some examples, the electronic display 140 can be an electrophoretic display, an electrowetting display, or an electrochromic display, also known an e-paper display and/or an e-ink display. Compared to LED-based displays, using the electrophoretic display can have certain advantages, e.g., reducing power consumption (e.g., may run for many years using a coin cell battery), having an "image memory" (e.g., power is only needed to change the display, and the displayed image can hold indefinitely until a voltage is applied to change the display), being considered bi-stable, and not requiring a backlight. Because the electrophoretic display reflects light, but do not emit light, it can improve readability, especially in bright conditions, and have wide visibility angles and high contrast (e.g., black/white and colors that are native ink appear bold while mixing native ink colors can fade/reduce contrast). The electrophoretic display can be configured to be thin and light-weight, and can be flexible (e.g., plastic backplane and/or film based). In some cases, the update timings can be on the order of less than 1600 msec, less than 1200 msec, less than 1000 msec, or less than 750 msec, e.g., when using native ink to generate colors, and for monochrome screens, the update timing can be on the order of less than 1000 msec, less than 850 msec, or less than 700 msec. In some case, the display may update faster if less than an entire screen is updated, for example, a partial image may update in less than 600 msec, less than 500 msec, less than 350 msec, or less than 300 msec. In some cases, the electrophoretic display can have a monochrome screen with an RGB filter, e.g., controlling the monochrome by applying different voltages to generate image on gray scale and then applying the RGB filter to provide colors for the user to experience (in which case the update timing is on the monochrome scale and not on the color scale). The electrophoretic display can be implemented in different ways, e.g., by using tiny capsules that contain fluid and ink (positive and negatively charged so applied voltage causes desired ink to be at surface). In some examples, the electronic display can be a segmented e-paper (or e-ink) display.

In some examples, the electronic display 140 can be a matrix display which can have any screen resolution, such as ranging from 10 pixel per inch (PPI) to 1000 PPI or higher, such as at least 200 PPI.

The images displayed by the electronic display can be black/white, greyscale, colored, or other color palate. The electronic display can have any shape, such as rectangular, trapezoidal, triangular, other polygonal shape, elliptical, oval, other rounded shape, or various irregular shapes. In some examples, selective portion(s) of the electronic display can be masked by parts of the body of the putter head so as to give appearance of any desired shape to a user of the putter head.

The surface area of the electronic display relative to the top surface area of the putter head can have any ratio, such as within a range from about 10% to about 90%, from about 20% to about 80%, and/or from about 30% to about 70%, such as at least 25%, at least 40% or at least 50%.

In certain examples, the electronic display can be placed symmetric about a midline bisecting the face of the putter head. In other examples, the display can be offset to either heel or toe side of the putter head.

In one particular examples, the electronic display can have a 1.8" (128×160), 31 mm×35 mm active area, with 2 PWM controllable LED backlight, a 4-wire SPI interface, microSD card holder, and can by powered by 5V or 3.3 V.

In some examples, the putter head can have more than one electronic display, such as being located at two different parts of the putter head separate from each other, such as one at the toe side and one at the heel side, front and back sides, etc.

The electronic display can be configured (e.g., via the controller) to display at least one alignment feature to assist a golfer to aim, such as based on position and/or motion data measured by one or more sensors. For example, the golfer can test various alignment features before the golfer's round of golf and select the best alignment feature.

In some examples, information other than the alignment feature can be presented to the electronic display. For example, a date/time clock, weather information (e.g., temperature, humidity, wind speed, etc.), an indicator of a sport teams, or any other information can be displayed. In some examples, the electronic display can provide an interface for customized display, e.g., showing a logo, scanning/receiving a broadcast, etc.

In certain examples, the electronic display can also be configured to allow read and/or write capabilities (e.g., select from pre-made offerings), e.g., via a touch-sensitive screen or other input means.

Additional Design Considerations

Now with the basic structure of the various putter components described and defined, key relationships between these components will be disclosed. As with all the relationships disclosed herein, these relationships are more than mere optimization, maximization, or minimization of a single characteristic or variable, and are often contrary to conventional design thinking yet have been found to achieve a unique balance of the trade-offs associated with competing criteria such as durability, viewability, weight distribution, CG placement, impact dynamics, and desired moments of inertia. The aforementioned balance requires trade-offs among the competing characteristics recognizing key points of diminishing returns. Therefore, this disclosure contains a unique combination of relationships that produce enhanced alignment features, as well as the location of the display and electronic components, viewability, durability, and impact resistance/durability of electronic components and reduce the negative attributes associated with the weight, placement, and fragility of such components. Further, the relative dimensions, including, but not limited to component masses, overall mass, inertias, length, width, cross-sectional dimensions, thickness, and their relationships to one another and the other design variables disclosed herein, influence the aforementioned criteria. Additionally, many embodiments have identified upper and/or lower limits ranges. For embodiments outside theses ranges or relationships, the performance may suffer and adversely impact the goals of the design.

In view of the above, a total weight of the putter head 100 can preferably range from 345 grams to 405 grams including the electronic assembly 104, any hosel 122, but excluding a golf club shaft. Additionally, the electronic assembly 104 preferably can have a mass between 2% and 20%, or between 3% and 15%, or between 5% and 12%, or between 10% and 16%, or less than 10% of the total weight of the putter head 100 including the hosel 122 and excluding the shaft.

Importantly, the more mass concentrated in the electronic assembly, the less discretionary mass a putter designer can work with to achieve goals related to CG placement and MOI or forgiveness. Additionally, the electronic assembly 104 concentrates mass near the center or CG of the putter head, which may be undesirable for optimizing CG placement and MOI. In most modern putter heads, the discretionary mass tends to be moved outwardly and away from the center of the putter and outward from the CG of the putter head, and the mass is typically placed at or along a perimeter of the putter head. However, to achieve enough playing time it is desirable to have a battery of a minimum size and no more than a maximum size to avoid taking away from the discretionary mass. Likewise, the screen and any protective lenses or covers must be confined within a range defined by a minimum mass (and size) and a maximum mass (and size). It is a careful balance to achieve a final product that will receive the approval of a golfer while meeting various design goals including durability and playability.

As disclosed in U.S. Pat. Nos. 9,827,479, 7,594,865, and 7,396,295, and incorporated by reference, the putter head includes a center of gravity (CG) having a CG X-axis, a CG Z-axis, and a CG Y-axis (see also FIGS. 1E-1G). The putter head CG includes all the components of the putter head including a hosel, the electronic assembly, a face insert, one or more attached weights, but not a shaft attached to the hosel or grip attached to the shaft. The CG Y-axis extends along the length of the putter from a rear to front direction and passes through the CG. In addition, the CG X-axis extends along the width of the putter head from a heel to toe direction, parallel to the face, and passes through the CG. The CG Z-axis extends in a vertical direction along the height of the putter head between a bottom and top portion. The CG is located to the rear of the center face of the putter head a distance CGy measured along the CG Y-axis. Further, the putter head has a front-to-rear length and a heel-to-toe width, as shown in FIG. 3 of U.S. Pat. No. 7,396,295. In one embodiment the CGy distance is at least 15 mm, and in further embodiments at least 20 mm, 25 mm, 30 mm, and 35 mm. In a further series of embodiments the CGy distance is no more than 70 mm, and in further embodiments no more than 65 mm, 60 mm, 55 mm, 50 mm, 45 mm, and 40 mm. In another embodiment the CGy distance is at least 35% of the front-to-rear length, and in further embodiments at least 37.5%, 40%, 42.5%, and 45%. In still a further series of embodiments the CGy distance is no more than 60% of the front-to-rear length, and in further embodiments no more than 57.5%, 55%, 52.5%, 50%, and 47.5%. In an embodiment the front-to-rear length is at least 60 mm, while in further embodiments it is at least 65 mm, 70 mm, 75 mm, and 80 mm.

Similarly, the electronic assembly 104 has its own center of gravity, referred to as CGea, as does the battery 125, referred to as CGb. The CGea is located to the rear of the center face of the putter head a distance CGeay measured along the CG Y-axis, and likewise the CGb is located to the rear of the center face of the putter head a distance CGb measured along the CG Y-axis. In one embodiment CGeay is less than CGy, while in a further embodiment CGeay is at least 5% less than CGy, and in still further embodiments at least 7.5%, 10%, 12.5%, 15%, 17.5%, and 20% less. In still another embodiment CGeay is at least 40% of CGy, and in further embodiments at least 45%, 50%, 55%, 60%, and 65%. Similarly, in one embodiment CGby is less than CGy, while in a further embodiment CGby is at least 5% less than CGy, and in still further embodiments at least 7.5%, 10%, 12.5%, 15%, 17.5%, and 20% less. In still another embodiment CGby is at least 40% of CGy, and in further embodiments at least 45%, 50%, 55%, 60%, and 65%. In still another embodiment CGby is less than CGeay, while in a further embodiment CGby is at least 5% less than CGeay, and in further embodiments at least 7.5%, 10%, 12.5%, 15%, 17.5%, and 20% less.

The elevation of the putter head CG, located vertically above a ground plane when positioned in a normal address position (this may be the same as a design lie position), is referred to as Zup. Similarly the elevation of the electronic assembly CGea, located vertically above the ground plane when the putter head is positioned in the normal address position, is referred to as Zup-ea; and the elevation of the battery CGb, located vertically above the ground plane when the putter head is positioned in the normal address position, is referred to as Zup-b. In one embodiment Zup-b is less than Zup, while in a further embodiment Zup-b is at least 5% less than Zup, and in further embodiments at least 7.5%, 10%, 12.5%, 15%, 17.5%, 20%, 22.5%, and 25% less. In another embodiment Zup-ea is plus or minus 20% of Zup, and in further embodiments plus or minus 17.5%, 15%, 12.5%, 10%, 7.5%, and 5%. Likewise, the elevation of an antenna for the communication system has an antenna center of gravity, referred to as CGa, located vertically above the ground plane when the putter head is positioned in the normal address position, is referred to as Zup-a. In one embodiment Zup-a is greater than Zup-b, while in a further embodiment Zup-a is at least 5% greater than Zup-b, and in still further embodiments is at least 7.5%, 10%, 12.5%, 15%, 17.5%, and 20% greater. Similarly, in another embodiment Zup-a is greater than Zup, while in a further embodiment Zup-a is at least 2.5% greater than Zup, and in still further embodiments is at least 5%, 7.5%, 10%, 12.5%, 15%, 17.5%, and 20% greater.

Figure 1F:
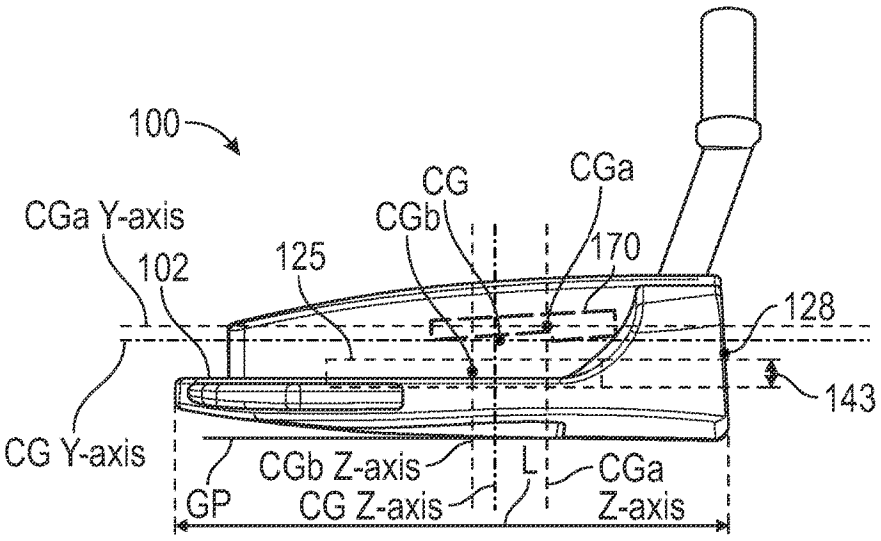
FIGS. 1E-1G show the putter head of FIG. 1A together with several coordinate systems centered on different center of gravities.
Figure 1E:
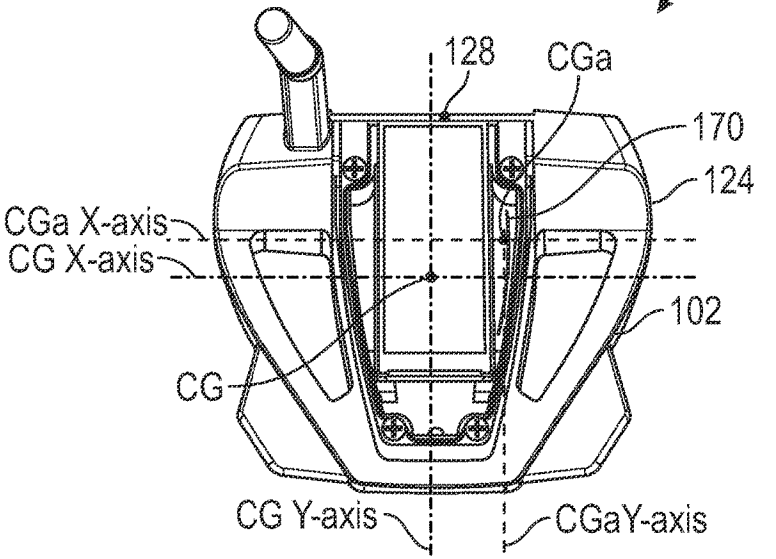
Figure 1G:
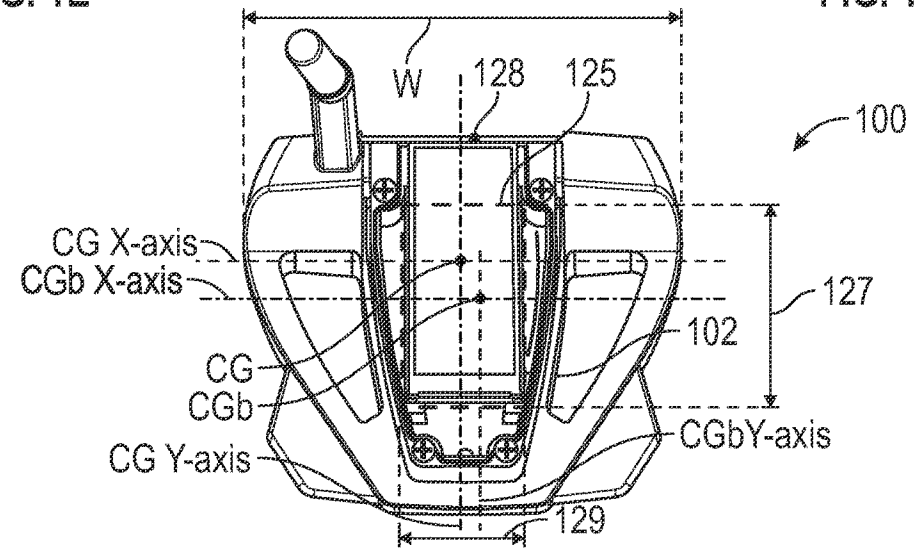

As disclosed in U.S. Pat. Nos. 9,827,479, 7,594,865, and 7,396,295, and incorporated by reference, the putter head includes a center of gravity (CG) having a CG X-axis, a CG Z-axis, and a CG Y-axis, as seen in FIGS. 1E-1G. The putter head CG includes all the components of the putter head including a hosel, the electronic assembly, a face insert, one or more attached weights, but not a shaft attached to the hosel or grip attached to the shaft. The CG Y-axis extends along the length (L) of the putter from a rear to front direction and passes through the CG. In addition, the CG X-axis extends along the width (W) of the putter head from a heel to toe direction, parallel to the face, and passes through the CG. The CG Z-axis extends in a vertical direction along the height of the putter head between a bottom and top portion. The CG is located to the rear of the geometric center 128 of the striking face 116 a distance CGy measured along the CG Y-axis. Further, the putter head has a front-to-rear length (L) and a heel-to-toe width (W), as shown in FIGS. 12 and 13. In one embodiment the CGy distance is at least 15 mm, and in further embodiments at least 20 mm, 25 mm, 30 mm, and 35 mm. In a further series of embodiments the CGy distance is no more than 70 mm, and in further embodiments no more than 65 mm, 60 mm, 55 mm, 50 mm, 45 mm, and 40 mm. In another embodiment the CGy distance is at least 35% of the front-to-rear length (L), and in further embodiments at least 37.5%, 40%, 42.5%, and 45%. In still a further series of embodiments the CGy distance is no more than 60% of the front-to-rear length (L), and in further embodiments no more than 57.5%, 55%, 52.5%, 50%, and 47.5%. In an embodiment the front-to-rear length (L) is at least 60 mm, while in further embodiments it is at least 65 mm, 70 mm, 75 mm, and 80 mm.

Similarly, the electronic assembly 104 has its own center of gravity, referred to as CGea, as does the battery 125, referred to as CGb. The CGea is located to the rear of the geometric center 128 a distance CGeay measured along the CG Y-axis, and likewise the CGb is located to the rear of the geometric center 128 a distance CGb measured along the CG Y-axis. In one embodiment CGeay is less than CGy, while in a further embodiment CGeay is at least 5% less than CGy, and in still further embodiments at least 7.5%, 10%, 12.5%, 15%, 17.5%, and 20% less. In still another embodiment CGeay is at least 40% of CGy, and in further embodiments at least 45%, 50%, 55%, 60%, and 65%. Similarly, in one embodiment CGby is less than 2 times CGy, while in a further embodiment CGby is less than 1.8 times, 1.6 times, 1.4 times, and 1.25 times. In still another embodiment CGby is at least 40% of CGy, and in further embodiments at least 45%, 50%, 55%, 60%, 65%, 70%, 75%, 80%, 85%, 90%, 95%, and 100%. Thus in an embodiment GCby is greater than CGy, and in another embodiment CGy is greater than CGay. In still another embodiment a first difference between CGby and CGy is less than a second difference between CGy and CGay. In still another embodiment CGby is less than CGeay, while in a further embodiment CGby is at least 5% less than CGeay, and in further embodiments at least 7.5%, 10%, 12.5%, 15%, 17.5%, and 20% less.

The elevation of the putter head CG, located vertically above a ground plane when positioned in a normal address position (this may be the same as a design lie position), is referred to as Zup. Similarly the elevation of the electronic assembly CGea, located vertically above the ground plane when the putter head is positioned in the normal address position, is referred to as Zup-ea; and the elevation of the battery CGb, located vertically above the ground plane when the putter head is positioned in the normal address position, is referred to as Zup-b. In one embodiment Zup-b is less than Zup, while in a further embodiment Zup-b is at least 5% less than Zup, and in further embodiments at least 7.5%, 10%, 12.5%, 15%, 17.5%, 20%, 22.5%, and 25% less. In another embodiment Zup-ea is plus or minus 20% of Zup, and in further embodiments plus or minus 17.5%, 15%, 12.5%, 10%, 7.5%, and 5%. Likewise, the elevation of an antenna for the communication system has an antenna center of gravity, referred to as CGa, located vertically above the ground plane when the putter head is positioned in the normal address position, is referred to as Zup-a. In one embodiment Zup-a is greater than Zup-b, while in a further embodiment Zup-a is at least 5% greater than Zup-b, and in still further embodiments is at least 7.5%, 10%, 12.5%, 15%, 17.5%, and 20% greater. Similarly, in another embodiment Zup-a is greater than Zup, while in a further embodiment Zup-a is at least 2.5% greater than Zup, and in still further embodiments is at least 5%, 7.5%, 10%, 12.5%, 15%, 17.5%, and 20% greater. In another embodiment Zup-a is greater than Zup, and Zup is greater than Zup-b, while in still another embodiment Zup is greater than the distance of the geometric center 128 above the ground plane (GP). In still another embodiment a third difference between Zup-a and Zup-b is at least 30% of Zup, and in further embodiments the third difference is at least 35%, 40%, 45%, and 50% of Zup. Careful positioning of the antenna 170 with respect to the battery 125 and the dense body 102 can help improve connectivity range for wireless communication and avoid interference. Even further, the position of the antenna 170 and the battery 125 can be used in the positioning of the overall CG. For instance, as shown in FIG. 11, in one embodiment CGa is located between the CG and the toe portion 124, and thus at least a portion of the antenna is located toeward of the CG, while in a further embodiment, seen in FIG. 13, CGb is located between the CG and the toe portion 124. In one such embodiment a first separation distance between the CGa Y-axis and the CG Y-axis, is greater than a second separation distance between the CGb Y-axis and the CG Y-axis. In fact, in a further embodiment the first separation distance is 2 times the second separation distance, and in additional embodiments it is at least 3 times, 4 times, 5 times, and 6 times. Additionally the size and shape of the battery 125 may be used to benefit the mass properties of the overall putter. The battery 125 has a battery length 127, seen in FIG. 13 and measured parallel to the CG Y-axis, a battery width 129, measured parallel to the CG X-axis, and a battery depth 143, seen in FIG. 12 and measured parallel to the CG Z-axis. In one embodiment the battery width 129 is at least 20% of the overall width W, and in further embodiments is at least 25%, 30%, 35%, and 40%. Further, in one embodiment the battery length 127 is at least 40% of the overall length L, and in further embodiments at least 45%, 50%, 55%, and 65%. In another series of embodiments the battery width 129 is no more than 95% of the overall width W, and in further embodiments is no more than 90%, 85%, 80%, 75%, and 70%. Further, in one embodiment the battery length 127 is no more than 95% of the overall length L, and in further embodiments is no more than 90%, 85%, 80%, and 75%. In one embodiment the battery depth 143 is no more than 50% of Zup, and in further embodiments is no more than 45%, 40%, 35%, and 30% and no less than 3% of Zup. All of the disclosed relationships identify unique ways to account for the undesirable impact of additional mass in nontraditional locations.

Minimizing the mass of the electronic assembly 104 can help achieving these stated goals. However, minimizing the mass of the electronic assembly 104 is often counter to maximizing playing time and maximizing screen size and screen durability. Preferably, when the putter head 100 is in a normal address position it has a CG that is positioned between 14 mm and 42 mm rearward of a center face of the putter head (CGy), more preferably a CGy between 22 mm and 32 mm, a MOI about a CG X-axis between 600 $g \cdot cm^2$ and 4400 $g \cdot cm^2$ (Ixx) and a moment of inertia about a CG Z-axis between 4400 $g \cdot cm^2$ and 8400 $g \cdot cm^2$ (Izz), more preferably an Ixx between 2200 $g \cdot cm^2$ and 3600 $g \cdot cm^2$ and an Izz between 4800 $g \cdot cm^2$ and 6600 $g \cdot cm^2$.

In some embodiments, the mass of the electronic assembly 104 may be positioned asymmetrically such that more of the mass is shifted either rearward or forward rather than a 50/50 split. Shifting more of the mass rearward such as between 60% to 90% of the mass rearward of a mid-line of the electronic assembly can help promoting greater inertia or resistance to twisting. However, shifting more of the mass forward such as between 60% to 90% of the mass forward of a mid-line of the electronic assembly may provide a better feel and greater feedback preferred by some golfers.

In one embodiment, the mass of the battery 125 is between 1 and 7.5 grams, preferably 1 to 5 grams, the screen type is an electrophoretic display (e.g., e-ink display) having up to eight colors and at least two colors (white and black are both considered colors) or a memory-in-pixel display (MIP). In this scenario, the mass of the electronic assembly 104 is between 8% and 16% of the total weight of the putter head 100. The mass of the electronic assembly 104 is preferably between 30 grams and 60 grams, and the mass includes any screws or adhesives used to secure the electronic assembly to the putter head body, and further includes any electronic components and controllers, buttons, screens (one or more screens), lens or screen covers, one or more batteries, any protective caps or covers, any gaskets, port covers, and any cases surrounding or housing the electronic assembly.

The battery 125 may be a replaceable coin cell battery or a rechargeable lithium-ion battery capable of wireless charging. An electrophoretic display uses very littler power to display an alignment feature, and power is primarily consumed when changing alignment features, e.g., when changing from a first alignment feature to a second alignment feature. Thus, a coin cell battery or other smaller battery may be used, which may offer weight savings over a rechargeable battery. It is important to balance overall playing time, battery charging or replacement intervals, and discretionary mass for achieving proper CG placement and MOI.

In another embodiment, the mass of the battery 125 is between 8 and 20 grams, which supports many other screen types previously discussed that have greater power consumption than an electrophoretic display. In this scenario, the mass of the electronic assembly is preferably between 8% and 19% of the total weight of the putter head 100. The mass of the electronic assembly is preferably between 30 grams and 60 grams, and the mass includes any screws or adhesives used to secure the electronic assembly to the putter head body, and may further includes any electronic components and controllers, buttons, screens (one or more screens), lens or screen covers, one or more batteries, any protective caps or covers, any gaskets, port covers, and any cases surrounding or housing the electronic assembly. As discussed above, too heavy of an electronic assembly may consume discretionary mass needed for meeting CG and MOI targets as well as other design goals. On the other hand, the screen and battery need to be sufficiently sized to provide enough playing time without the need to constantly recharge the device or change batteries, especially during a round of golf.

A round of golf may range anywhere from 4 hours to 6 hours and a putter is typically used for about half of the shots in a round of golf. A fully charged battery connected to the putter is intended to have at a minimum of 4.5 to 6 hours of continuous playing time, which should be sufficient for at least two rounds of golf and some practice time in between. An electrophoretic display paired with a coin cell battery could last days to months due to its low power consumption. On the other hand, other non-electrophoretic displays may support tasks requiring a higher refresh rate, e.g., video playback. For example, putting instructional videos and tips could be displayed on the other screen types, or other visuals such as showing the slope of a green complex.

In some examples, the battery 125 may be located within the electronic assembly and the battery may have a total milli amp hour (mAh) rating between 25 mAh and 620 mAh, and a total mass of between 1 gram and 15 grams. The total battery mass and mAh rating would vary with screen type and design goals. As discussed above, for a coin cell battery the total mass may range from 1 gram to 5 grams and one could still achieve a mAh rating between 25 mAh and 620 mAh. Similarly, for a rechargeable battery a mass could range from 8 grams to 15 grams and be able to achieve a mAh rating between 25 mAh and 620 mAh. Larger batteries could be used depending on the applications, e.g., batteries ranging from 600 mAh to 2500 mAh may be used, but of course there will be tradeoffs as discussed throughout the specification.

The putter head including the electronic assembly will be exposed to the elements and various weather conditions, e.g., rain, wind, dust, heat, etc. Accordingly, it is important that the electronic components be sealed within the electronic assembly. Some of the sealant may be accomplished using various foams that include adhesives on either side to act as a gasket to seal a lens and cap or cover together. In some instances, the electronic assembly may be hermitically sealed making it initially airtight and watertight. In other instances, the electronic assembly may meet certain standardized testing requirements such as International Protection or, in some cases, Ingress Protection rating such as IPX4 or higher, IPX5 or higher, IPX6 or higher, IPX7 or higher, and up to and including IPX8 so a rating between IPX4 and IPX8 is appropriate. This should provide sufficient protection against windblown dust and rain, splashing water, hose-directed water, and ice formation. Preferably, the electronic assembly can be configured to be dust protected so that it would achieve a rating of IP54 or above, preferably a rating of IP64 or above, and up to and including a rating of IP68 or IP69.

When used herein, "water tight seal" does not necessarily prevent all water from entry in any condition, such as long term submersion. A water tight seal may be a seal that prevents water entry from water spray, water jets, and/or limited submersion. For example, a water tight seal as used herein may have an Ingress Protection ("IP") rating of at least IP62, IP63, IP64, IP65, IP66, or IP67. Similarly, a "dust tight seal" as used herein may not prevent all dust from entry. A dust tight seal prevents dust from entering in sufficient quantities to interfere with satisfactory operation of the device. For example, a dust tight seal may have a solids rating of at least IP5x or IP6x. The electronic assembly may have one or more double-sided adhesives used between various components to prevent water ingress.

In certain examples, as depicted in FIG. 2C, the lens 146 can include one or more ribs 145 along a perimeter of the lens 146. The ribs 145 can be configured to mate with corresponding grooves 147 located on the housing 134. The one or more ribs can be adhered to the housing 134 or the case.

In certain examples, the electronic assembly 104 can include one or more double-sided adhesives for sealing one or more openings in the housing 134 or one or more openings in the top portion 112 of the putter head. For example, a double-sided adhesive member 133 can be sandwiched between the housing 134 and the switch 138. As another example, at least one double-sided adhesive, e.g., the foam 107, can be sandwiched between the lens 146 and cap 108 in the top portion 112 of the putter head.

As described herein, the double-sided member 133 and/or the foam 107 can be configured to prevent water ingress such that the electronic assembly 104 is at least partially sealed and has an Ingress Protection rating (IPXX) between IP54 and IP69.

Angling either one of or both of the electronic display 140 and protective lens 146 helps with water runoff and to avoid water pooling, and can also help controlling the direction of water flow. Accordingly, it may be desirable to angle the electronic display such that it is angled in a front-to-back direction such that a first elevation at a forward portion of the electronic display is greater than a second elevation at a rearward portion of the electronic display as measured relative to a ground plane when the putter head is in a normal address position. Likewise, it may be desirable to angle the lens such that it is angled in a front-to-back direction such that a first elevation at a forward portion of the lens is greater than a second elevation at a rearward portion of the lens as measured relative to a ground plane when the putter head is in a normal address position. Additionally, or alternatively, one or both of the lens and electronic display may be curved (as described above) to aid in directing water flow.

As mentioned above, concentrating the mass of the electronic assembly 104 at the center of the putter is undesirable for meeting CG placement goals and inertia (MOI) targets. However, the electronic case or housing 134 needs to be of a minimum size to be durable and to protect the sensitive components housed within the case. With this in mind, it is preferable to minimize the mass of the electronic assembly while balancing battery life and screen size. Preferably a mass of the electronic assembly divided by a water displaced volume of the electronic assembly is between 0.25 g/cm$^3$ and 1.75 g/cm$^3$, more preferably a mass of the electronic assembly divided by a water displaced volume of the electronic assembly is between 0.25 g/cm$^3$ and 1.50 g/cm$^3$, even more preferably a mass of the electronic assembly divided by a water displaced volume of the electronic assembly is between 0.25 g/cm$^3$ and 1.25 g/cm$^3$.

The electronic assembly 104 could be configured into a range of shapes and sizes. The shape as shown is just one exemplary embodiment. However, a cylindrical shape is also envisioned having a circular screen as seen on various smart watches. With that in mind, some target dimensions and masses for the electronic assembly are provided. In some embodiments, the electronic assembly has a length as measured in a front to back direction ranging from 40 mm to 100 mm, a width as measured in a heel to toe direction ranging from 20 mm to 45 mm, a height as measured top to bottom ranging from 12 mm to 40 mm, and a mass ranging from 30 grams to 60 grams. In one example, a circular screen would have a diameter ranging from about 30 mm to about 50 mm, preferably about 42 mm which is similar to the diameter of a golf ball.

Example Alignment Features

Figure 7L:
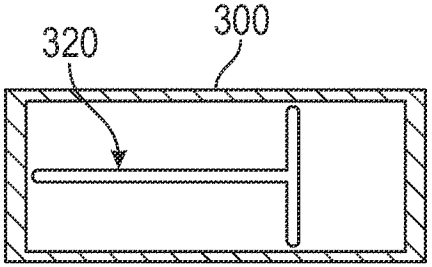
FIGS. 7A-7O depict various example sight lines that can be displayed on an electronic display of a putter head.
Figure 7K:
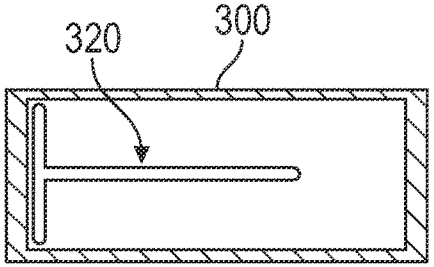
Figure 7J:
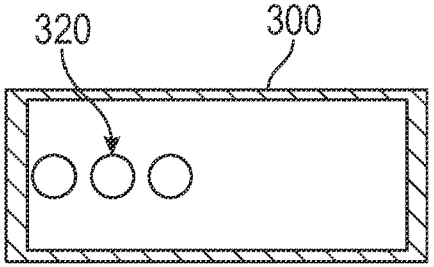
Figure 7O:
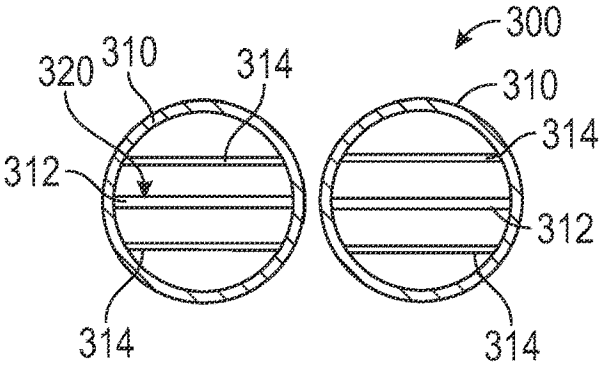
Figure 7N:
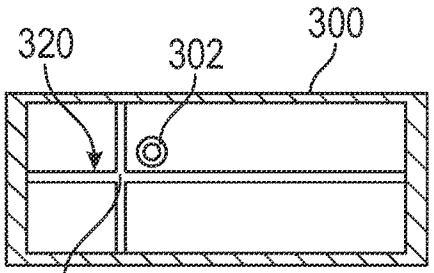

FIGS. 7A-7O show various example alignment features 320 that can be displayed on an electronic display 300 of a putter head. The electronic display 300 can be the electronic display 140 or 240 described above. For simplicity, the electronic display 300 in FIGS. 7A-7N is shown to have a rectangular shape. Nevertheless, it is to be understood that the electronic display 300 can have a different shape, as described above. In FIGS. 7A-7N, the left part of the rectangle represents the front part of the electronic display 300 and the right part of the rectangle represents the rear part of the electronic display 300. The front part of the electronic display 300 is closer to the striking face of the putter head than the rear part of the electronic display 300. In some examples, the front edge of the electronic display 300 can be aligned with or adjacent to the striking face of the putter head.

In certain examples, the controller embedded within the putter head can be configured to select an alignment feature 320 from a plurality of alignment features and display the selected alignment feature 320 on the electronic display. Generally, the displayed alignment feature 320 can extend from the front part of the electronic display 300 to the rear part of the electronic display 300.

In certain examples, the alignment feature 320 can include one or more sight lines extending from the front part of the electronic display toward the rear part of the electronic display (see, e.g., FIGS. 7A-7H). The sight lines can be configured to have various lengths, widths, and/or contrasting colors. The sight lines can also be configured to have various line styles (e.g., solid, dashed, dotted, dash-dotted, etc.). Such sight lines can indicate a direction for aiming/putting.

In some examples, the alignment feature 320 can include a single straight sight line (e.g., FIGS. 7A-7B, 7H). The single sight line can extend a full length of the electronic display (e.g., FIGS. 7A and 7H) or only a partial length of the electronic display (e.g., FIG. 7B). In any examples described herein, a partial length of the electronic display can be a predefined percentage of the full length of the electronic display, wherein the percentage can be any value between 0 and 100% (e.g., 10%, 20%, 25%, 33%, 40%, 50%, 67%, 75%, 80%, etc.).

In some examples, the alignment feature 320 can include a plurality of sight lines, such as two parallel sight lines (e.g., FIGS. 7C-7D), triple sight lines (e.g., FIGS. 7E-7G), or more than three sight lines. In some examples, the multiple sight lines can all extend a full length of the electronic display (e.g., FIG. 7C). In some examples, the multiple sight lines all extend partial lengths of the electronic display (e.g., FIGS. 7D, 7F-7G). In some examples, one or more of the multiple sight lines can extend a full length, whereas the remaining sight lines extend only partial lengths of the electronic display (e.g., FIG. 7E). In some examples, all sight lines in an alignment feature have about the same length (e.g., FIGS. 7C-7D and 7F). In other examples, multiple sight lines in an alignment feature can have different lengths (e.g., FIGS. 7E and 7G).

In the examples depicted in FIGS. 7A-7G, the sight lines are perpendicular to a front edge of the electronic display and the striking face of the putter head. In some examples, as depicted in FIG. 7H, the sight line(s) can form an oblique angle relative to the front edge of the electronic display, i.e., the sight line(s) can be non-perpendicular relative to the striking face of the putter head. While the sight line depicted in FIG. 7H tilts toward an upper edge of the electronic display, the sight line can also tilt toward the lower edge in other examples. Generally, the angle formed between the sight lines(s) and the striking face can be any value between 0 and 180 degrees. In the examples depicted in FIGS. 7A-7H, the sight lines are straight. In other examples, the sight lines can be curved (e.g., forming one or more arcs).

Figure 7M:
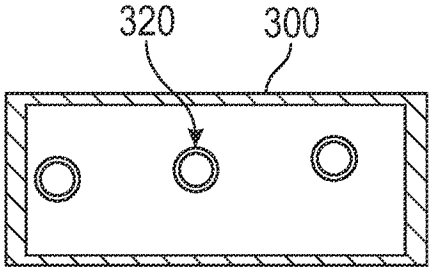

In some examples, the alignment feature 320 can be represented by one or more predefined shapes (e.g., circles, ovals, squares, triangles, or the like) along a line. As described herein, an imaginary line connecting the one or more predefined shapes is also referred to as a sight line. For example, FIG. 7I shows a single circle, whereas FIGS. 7J and 7M show three circles arranged in a sight line extending from the front part of the electronic display toward the rear part of the electronic display. The predefined shapes (e.g., circles) can have various sizes, filling patterns, contrasting colors, or the like. Similarly, the sight line connecting the predefined shapes can be perpendicular to the striking face of the putter head (e.g., FIG. 7J) or form an oblique angle relative to the striking face of the putter head (e.g., FIG. 7M). Additionally, the sight line connecting the predefined shapes can be straight or curved. The distance between two adjacent predefined shapes can also vary (e.g., the distance between two adjacent circles in FIG. 7J is closer than that in FIG. 7M).

In certain examples, the alignment feature 320 can have a T-shaped display pattern (e.g., FIGS. 7K-7L) or a cross-shaped display pattern (e.g., FIG. 7N). In such cases, a first line can be perpendicular to the striking face and a second line can be parallel to the striking face of the putter (e.g., FIGS. 7K, 7L and 7N). Alternatively, a first line can form an oblique angle relative to the striking face of the putter, and a second line can be perpendicular to the first line. In such cases, the first line can indicate a direction for putting, and a second line can indicate whether the putt head is tilted in one way or another (e.g., forward or backward tilt, and/or left or right tilt). In certain examples, an indicator 302 (e.g., a dot/circle/bubble/line or other shaped object) can appear at the intersection 304 between the first and second lines. When the indicator 302 overlaps with an intersection 304 of the two lines, it can indicate that the putter head is in a neutral or un-tilted state. Displacement of the indicator 302 from the intersection 304 can indicate the putter head is in a tilted state. The location of the indicator 302 relative to the intersection 304 can indict a direction and/or the degree of the tilting of the putter head. For example, the indicator 302 being positioned toeward of the intersection 304 can indicate that the putter head is tilted with the toe end being higher than the heel end (e.g., a lie angle that is smaller than desired). Similarly, the indicator 302 being positioned rearward and heelward of the intersection 304 can indicate that the rear-heel side is higher than the front-toe side (e.g., a lie angle that is greater than desired and a loft angle that is smaller than desired). This indicator feature can function similar to a bubble level in carpentry, though using sensors and electronics rather than a gas bubble in a liquid.

In certain examples, the electronic display 300 can comprise two or more display windows of a predefined shape (e.g., circle, square, etc.), and the alignment feature 320 (e.g., sight lines) can extend through the display windows. For example, FIG. 7O shows two circular display windows 310 that are spaced apart from one another, and three sight lines extend through both windows 310. The three sight lines can include a central sight line 312 and two side sight lines 314 located on both sides of and being parallel to the central sight line 312. The central sight line 312 can have a different line property (e.g., thickness, color, line style, etc.) than the two side sight lines 314. In the depicted example, the two circular windows 310 have the same size and spaced apart from one another such that the central sight line 312 and the two side sight lines 314 are visibly discontinuous at a gap formed between the first and second circular windows 310. In other examples, the two windows 310 can have different sizes, and/or contact each other.

As described above, because of individual differences, an alignment feature that aids one golfer may not be helpful for another golfer. Even an alignment feature that works for a golfer in one putting situation may not be ideal for the same golfer in another putting situation. Thus, by allowing a golfer to select an alignment feature from a plurality of alignment features can advantageously offer flexibility and adaptability.

In certain examples, the controller embedded within the putter head can be configured to wirelessly receive data from a mobile computing device (e.g., 150), and display an alignment feature on the electronic display based on the data received from the mobile computing device. For example, through a user interface of an application running on the mobile computing device, a golfer can select an alignment feature from a plurality of predefined alignment features, and then transmit such selected alignment feature to the controller of the putter head. The putter head can then use that selected alignment feature for display. In certain examples, the golfer can create, edit, delete, and/or save an alignment feature through a user interface of the mobile computing device.

In certain examples, the electronic display of the putter head can have a touch screen that allows a user to select an alignment feature from a plurality of predefined alignment features. The predefined alignment features can be stored in a data storage device embedded within the electronic assembly of the putter head. In certain examples, the predefined alignment features stored in the data storage device can be programmed by and/or wirelessly transmitted from a mobile computing device (e.g., 150). In some examples, the mobile computing device can remotely program the software code and/or data to be used by the controller of the putter head.

In certain examples, instead of using a touch screen, the putter head can have a switch (which can be the same switch 138 described above or a separate switch) configured to allow a golfer to select an alignment feature for display. For example, the plurality of predefined alignment features can have a predefined sequence. By pushing the switch sequentially, the controller can loop through the sequence, thereby allowing the golfer to select one of the alignment feature for display.

In certain examples, an orientation of the displayed alignment feature can be adjusted by a golfer, e.g., by operating the mobile computing device and/or using the touch screen/switch on the putter head. For example, an initially selected alignment feature can be a single sight line that is perpendicular to a striking face of the putter head. The golfer can change the angle of the sight line (e.g., by remotely operating the mobile computing device and/or using the touch screen of the electronic display) so that the sight line forms a desired angle (e.g., more or less than 90 degree) relative to the striking face of the putter head.

In certain examples, an angle of the displayed alignment feature relative to the striking face of the putter head can be automatically adjusted based, at least partially, on data measured by one or more sensors (e.g., a 9-axis IMU sensor) embedded within the putter head. As a result, tilting of the putter head in or more directions can change orientation of the display alignment feature relative to the striking face of the putter head.

In some examples, in addition to or lieu or displaying alignment features, other information (e.g., flags, emojis, words, indicators, etc.) can be presented on the electronic display to indicate alignment status, whether the putter head is tilted, and/or other information. Audio and/or tactile feedback (e.g., in the form of a beeping sound, other sounds, vibrations, pulses, and/or other feedback) can be provided to the golfer to communicate information.

In certain examples, one or more sensors can measure lie angle and/or loft angle throughout swing or at least at initial setup and impact. The electronic display can be configured to provide information on current lie angle, current loft angle, current face angle, and/or other alignment/orientation properties.

In certain examples, the electronic display can be configured to recommend a style of putter based on stroke type (e.g., arc vs. straight), recommend loft based on presented loft, recommend lie angle based on presented lie, etc.

In certain examples, the electronic display can be configured to operate in a "training" mode, e.g., by utilizing a 9-axis IMU sensor for feedback and suggestions on putting alignment.

In certain examples, one or more sensors embedded in the putter head can be configured to measure a plurality of putting parameters (e.g., lie angle, loft angle, putting position, swing acceleration, etc.). The measured putting parameters can be wirelessly transmitted to a mobile computing device (e.g., 150), which can analyze the putting parameters, present the putting parameters or statistics of the putting parameters through a user interface of the mobile computing device.

Example Battery Management

The electronic circuit can be configured to have a low-power mode (LPM) and a high-power mode (HPM). In the HPM, the electronic display (e.g., 140, 240, 300) and most other electronic components are turned on. In the LPM, only one or more selected sensors (also referred to as "activation sensors" herein) are turned on while the electronic display and most other electronic components can be turned off (i.e., in "sleep mode") so as to reduce power consumption. In certain examples, the electronic circuit can be configured to have multi-tier power modes, e.g., HPM, LPM, ultra-low power mode (ULPM), etc. For example, the ULPM can have an even lower power consumption rate than the LPM by deactivating selected sensors.

In some examples, one or more light sensors can be configured as activation sensors. For example, the light sensors can be located on the putter head or electronic display and coupled to one or more accelerometers and/or gyroscopes and/or magnetometers. Removal of the putter head cover can expose and activate the light sensor, which in turn can wake up or activate the accelerometer. As a result, the operational mode of the electronic circuit can be switched from the ULPM to the LPM. When the accelerometer, gyroscope, and/or magnetometer moves from a first orientation (e.g., substantially vertical in the case of a bag on golf cart or push cart, or approximately horizontal in the case of being carried in a carry bag on a person's back) to an address orientation, it can switch the operational mode of the electronic circuit from LPM to HPM. In certain examples, a timeout feature can be implemented so that when there is no movement of the putter for a predefined duration (e.g., 1 minute, 5 minutes, etc.), the electronic circuit can switch from HPM to LPM or from HPM to ULPM. In certain examples, inserting the putter head into the head cover can cover the light sensor, which in turn can cause the electronic circuit to switch from HPM or LPM or from HPM to ULPM. In certain examples, after a predefined passage of time (e.g., 1 minute, 30 seconds, etc.) when the electronic circuit is in LPM, the operational mode of the electronic circuit can be switched to the ULPM.

In some examples, one or more magnetometers can be configured as activation sensors. For example, the magnetometers can be located on the putter head or electronic display and coupled to one or more accelerometers or gyroscopes. A magnet can be embedded in the putter head cover (or the putter bag, cart, a tag, or the like) so that it can be magnetically coupled with the magnetometers when they are in close proximity with each other. Thus, removal of the putter head cover or the putter bag (or remove the putter from the cart, away from the tag, etc.) can activate the magnetometers, which in turn can wake up or activate the accelerometer. As a result, the operational mode of the electronic circuit can be switched from the ULPM to the LPM. Similarly, when the accelerometer, gyroscope, and/or magnetometer moves from a first orientation (e.g., substantially vertical in the case of a bag on golf cart or push cart, or approximately horizontal in the case of being carried in a carry bag on a person's back) to an address orientation, it can switch the operational mode of the electronic circuit from LPM to HPM. Likewise, the electronic circuit can be switched from HPM to LPM (or ULPM) after a predefined a timeout period. Also, the electronic circuit can be switched from HPM or LPM to ULPM when inserting the putter head into the head cover (thus reestablishing the magnetic communication between the magnetometers and the magnet).

In certain examples, the accelerometers and/or gyroscopes and/or magnetometers can be configured as activation sensors (e.g., detecting linear or rotational movement of the putter head) or detecting an orientation change, e.g., from substantially vertical to an address position or substantially horizontal to an address position.

In certain examples, a proximity sensor, a touch sensor, a face identification sensor (e.g., a camera which can detect a person is looking at the putter head), or the like, can be configured as activation sensors (e.g., detection the presence of a person adjacent the putter head).

In certain examples, a battery capacity indicator can be displayed on the electronic display and/or the mobile computing device. In certain examples, a low battery warning can be generated when the battery capacity drops below a predefined level (e.g., less than 20% of full capacity). Such warning signal can be generated through a visual display on the electronic display, an audible sound, and/or a warning message delivered through a mobile device. In certain examples, detection of excessive heat (e.g., a temperature sensor can be configured to measure the temperature of the battery) can also generate a warning signal in a similar manner.

Example Mobile Communication

As depicted in FIG. 3 and described above, the electronic circuit in the putter head 100 or 200 can wirelessly communicate with a mobile computing device 150, which can be a smart phone, a smart watch, a personal digital assistant (PDA), a tablet, or other types of wearable/portable device. The wireless communication can be in the form of Bluetooth™ Bluetooth Low Energy, WiFi, etc. The mobile computing device 150 can receive data measured by the sensors located on the putter head 100 or 200. All information presented on the electronic display of the putter head can be displayed on the mobile computing device 150. In addition, the mobile computing device 150 can be configured to perform additional analysis of the position and/or motion data and provide instructions and/or recommendations for the golfer. In certain examples, the mobile computing device 150 can further transmit the sensor measured data to a remote server, which can cloud source data measured from different golfers and perform more advanced analysis and provide individualized recommendations or training modules. Communication between the mobile computing device 150 and the remote server is described further below in "Example Cloud Computing Environment."

The communication system may include an antenna. The antenna is located an antenna separation distance from the body 102. In one embodiment every portion of the antenna has an antenna separation distance of at least 1 mm, and at least 2 mm, 3 mm, 4 mm, and 5 mm in further embodiments. Similar to the putter head CG, the antenna CGa establishes a CGa X-axis extends along the width of the putter head from a heel to toe direction, and parallel to the CG X-axis, a CGa Z-axis parallel to the CG Z-axis, and a CGa Y-axis parallel to the CG Y-axis. In one embodiment the body 102 is configured so that no ferromagnetic portion of the body 102 intersects the CGa X-axis, while in a further embodiment no portion of the body 102 having a density above 5 g/cc intersects the CGa X-axis, while in still another embodiment no portion of the body 102 having a density above 3 g/cc intersects the CGa X-axis, and in still a further embodiment no portion of the body 102 intersects the CGa X-axis. In another embodiment these relationships are true not just at the CGa X-axis, but also true for 5 mm in front, or behind, the CGa X-axis, and in further embodiments for at least 7.5 mm, 10 mm, 12.5 mm, 15 mm, and 17.5 mm in front, or behind, the CGa X-axis. In one embodiment the body 102 is configured so that no ferromagnetic portion of the body 102 intersects the CGa Z-axis, while in a further embodiment no portion of the body 102 having a density above 5 g/cc intersects the CGa Z-axis, while in still another embodiment no portion of the body 102 having a density above 3 g/cc intersects the CGa Z-axis, and in still a further embodiment no portion of the body 102 intersects the CGa Z-axis. In another embodiment these relationships are true not just at the CGa Z-axis, but also true for 5 mm in front, or behind, the CGa Z-axis, and in further embodiments for at least 7.5 mm, 10 mm, 12.5 mm, 15 mm, and 17.5 mm in front, or behind, the CGa Z-axis. In still another embodiment the body 102 is configured so that no ferromagnetic portion of the body 102 located rearward of the CGa X-axis intersects the CGa Y-axis, while in a further embodiment no portion of the body 102 with a density above 5 g/cc located rearward of the CGa X-axis intersects the CGa Y-axis, while in a further embodiment no portion of the body 102 with a density above 3 g/cc located rearward of the CGa X-axis intersects the CGa Y-axis, and in yet another embodiment no portion of the body 102 located rearward of the CGa X-axis intersects the CGa Y-axis. In another embodiment these relationships are true not just at the CGa Y-axis (behind the CGa X-axis), but also true for 5 mm toward the heel or toe, and in further embodiments for at least 7.5 mm, 10 mm, 12.5 mm, 15 mm, and 17.5 mm toward the heel or toe. The antenna is generally positioned within the electronic assembly and above the battery i.e. further away from a ground plane than the battery and the antenna may be positioned proximate the electronic display. The antenna may be positioned on either side of the electronic display, rearward of the electronic display, and even underneath the electronic display. One preferred location for the antenna is on the side of the electronic display opposite the hosel and golf club shaft. Careful positioning of the antenna can help improve connectivity range for wireless communication and avoid interference. In some embodiments, the cap and case housing the electronic assembly may be formed from an aluminum alloy, various plastics, and other low density materials preferably having a density between 0.25 g/cm^3 and 5.0 g/cm^3, more preferably having a density between 0.25 g/cm^3 and 3.0 g/cm^3. Other more dense materials may be detrimental to wireless communication range.

As depicted in FIG. 3 and described above, the electronic circuit in the putter head 100 or 200 can wirelessly communicate with a mobile computing device 150, which can be a smart phone, a smart watch, a personal digital assistant (PDA), a tablet, or other types of wearable/portable device. The wireless communication can be in the form of Bluetooth™ Bluetooth Low Energy, WiFi, etc. The mobile computing device 150 can receive data measured by the sensors located on the putter head 100 or 200. All information presented on the electronic display of the putter head can be displayed on the mobile computing device 150. In addition, the mobile computing device 150 can be configured to perform additional analysis of the position and/or motion data and provide instructions and/or recommendations for the golfer. In certain examples, the mobile computing device 150 can further transmit the sensor measured data to a remote server, which can cloud source data measured from different golfers and perform more advanced analysis and provide individualized recommendations or training modules. Communication between the mobile computing device 150 and the remote server is described further below in "Example Cloud Computing Environment."

The communication system may include an antenna 170, seen in FIGS. 1E-1G and 2B. The antenna 170 is located an antenna separation distance from the body 102. In one embodiment every portion of the antenna 170 has an antenna separation distance of at least 1 mm, and at least 2 mm, 3 mm, 4 mm, and 5 mm in further embodiments. Similar to the putter head CG, the antenna CGa establishes a CGa X-axis extends along the width of the putter head from a heel to toe direction, and parallel to the CG X-axis, a CGa Z-axis parallel to the CG Z-axis, and a CGa Y-axis parallel to the CG Y-axis. In one embodiment the body 102 is configured so that no ferromagnetic portion of the body 102 intersects the CGa X-axis, while in a further embodiment no portion of the body 102 having a density above 5 g/cc intersects the CGa X-axis, while in still another embodiment no portion of the body 102 having a density above 3 g/cc intersects the CGa X-axis, and in still a further embodiment no portion of the body 102 intersects the CGa X-axis. In another embodiment these relationships are true not just at the CGa X-axis, but also true for 3 mm in front, behind, or radially from the CGa X-axis, and in further embodiments for at least 5 mm, 7.5 mm, 10 mm, 12.5 mm, 15 mm, and 17.5 mm in front, behind, or radially, from the CGa X-axis. In one embodiment the body 102 is configured so that no ferromagnetic portion of the body 102 intersects the CGa Z-axis, while in a further embodiment no portion of the body 102 having a density above 5 g/cc intersects the CGa Z-axis, while in still another embodiment no portion of the body 102 having a density above 3 g/cc intersects the CGa Z-axis, and in still a further embodiment no portion of the body 102 intersects the CGa Z-axis. In another embodiment these relationships are true not just at the CGa Z-axis, but also true for 3 mm in front, behind, or radially, from the CGa Z-axis, and in further embodiments for at least 5 mm, 7.5 mm, 10 mm, 12.5 mm, 15 mm, and 17.5 mm in front, behind, or radially from the CGa Z-axis. In still another embodiment the body 102 is configured so that no ferromagnetic portion of the body 102 located rearward of the CGa X-axis intersects the CGa Y-axis, while in a further embodiment no portion of the body 102 with a density above 5 g/cc located rearward of the CGa X-axis intersects the CGa Y-axis, while in a further embodiment no portion of the body 102 with a density above 3 g/cc located rearward of the CGa X-axis intersects the CGa Y-axis, and in yet another embodiment no portion of the body 102 located rearward of the CGa X-axis intersects the CGa Y-axis. In another embodiment these relationships are true not just at the CGa Y-axis (behind the CGa X-axis), but also true for 3 mm toward the heel or toe, and in further embodiments for at least 5 mm, 7.5 mm, 10 mm, 12.5 mm, 15 mm, and 17.5 mm toward the heel or toe. The antenna 170 is generally positioned within the electronic assembly and above the battery, i.e., further away from a ground plane than the battery and the antenna 170 may be positioned proximate the electronic display. The antenna 170 may be positioned on either side of the electronic display, rearward of the electronic display, and even underneath the electronic display. One preferred location for the antenna 170 is on the side of the electronic display opposite the hosel and golf club shaft. Careful positioning of the antenna 170 can help improve connectivity range for wireless communication and avoid interference. In some embodiments, the cap and case housing the electronic assembly may be formed from an aluminum alloy, titanium alloy, magnesium alloy, various plastics, composite materials such as prepreg materials and bulk moulding compound materials, and other low-density materials preferably having a density between 0.25 g/cm$^3$ and 5.0 g/cm$^3$, more preferably having a density between 0.25 g/cm$^3$ and 3.0 g/cm$^3$. Other more dense materials may be detrimental to wireless communication range.

Example Fitting and Self-Fitting Software Application

A putter fitting can involve much more than selecting a particular putter shape, hosel type, shaft length, grip, it can also involve selecting a particular sight line or no line. Tour pros and amateurs alike can benefit from a proper fitting. Once the particular putter shape, hosel type, shaft length, and grip are chosen one can focus on the alignment feature or sight line. One fitting example of a tour player, involved building 12 identical putters with the only variable being the alignment feature. This is costly and time consuming.

Having an electronic display attached to a putter head and configured to display a multitude of alignment features solves the problem of needing a multitude of putters and solves the problem of the putters not being built exactly the same, which eliminates many variables so one can focus solely on the alignment feature.

A fitter could walk a golfer through a putter fitting, or a software application configured to run on a smart device could also walk a golfer through a putter fitting. The software application would be configured to communicate with the putter (wirelessly), configured to adjust the alignment feature, and configured to record various statistics related to each alignment feature including putts made, putts missed, proximity to the hole, bias tendency does the ball tend to miss left or right of the hole. The software application may further include an ability to record photos (static images) or videos of a golfer putting from various vantage points including down the line and face on.

Down the line may indicate how well an alignment feature helps a particular golfer aim i.e., do they tend to aim at the target, left of the target (e.g., 6 inches left), or right of the target (e.g., 2 inches right) and by how much. The software application may step the golfer through a putter fitting where the golfer hits one or more putts (e.g., 3 to 7 putts) from various distances, e.g., short putts of about 5 feet (e.g., 3 to 7 putts), medium putts of about 10 feet (e.g., 3 to 7 putts), and long putts of about 20 feet (e.g., 3 to 7 putts). The software application is then configured to record putts made, putts missed, and proximity to the hole for each alignment feature used including a lack of an alignment feature. The software application may be configured to have a user input some or all of the information. The software application may then present statistics or results of the putter fitting and may rank the alignment features or be configured to suggest one, two, or three alignment features based on user performance. Or provide a score for each alignment feature at each distance as well as an aggregate or total score, e.g., 83 out of 100 at 10 feet or 72 out of 100 in the aggregate. A score from one distance, e.g., 10 feet may be weighted higher or lower than scores from other distances in determining an aggregate score. Or, a user may choose a preferred weighting for each distance e.g. a user may weight putts from 5 feet higher than putts from 20 feet. For example, if five putts are used form each distance, a made putt may be worth 20 points, a missed putt within a radius of 18 inches may be worth 15 points, a missed putt within 19 to 36 inches may be worth 12 points, and a missed putt within 37 to 54 inches may be worth 10 points. For any putt left short of the hole one or more points may be subtracted to encourage getting the ball to the hole and preferably 12 to 18 inches beyond the hole for missed putts. For example, a putt that is short and within 19 to 36 inches may lose 2 points for a total of 10 points (12-2), and a short putt within 37 to 54 inches may lose 3 points and so on and so forth, i.e., outside of 54 inches may lose 4 points if the putt is short.

The software application may also use an askew or angled alignment (angled relative to the face) feature to determine influence on path, line, and target aiming. This may be unknown or imperceptible to the user.

In addition to fitting a golfer to a particular alignment feature or recommending an alignment feature, the software application may be configured to record other statistics such as putts made and proximity to hole for putts of different lengths, e.g., 3 feet, 5 feet, 10 feet, 15 feet, and 20 feet. The software application may report performance metrics for the golfer at each of these distances and suggest areas needing practice. The software application may use the same scoring methodology as discussed above or other methodologies such as make percentage or strokes gained. The software application could report strokes gained in comparison to known PGA professional statistics or compare the golfer's statistics or make percentage to that of a PGA or other users of the software application or select users. The software application may also identify certain tendencies such as distance control, i.e., most putts are within a radius of 17-18 inches or most putts are outside a radius of 17-18 inches, or a tendency to leave putts of a certain length short, or a tendency to miss left or right, or a tendency to read too much or too little break.

The above are examples, and many other combinations are contemplated.

Example Additional Features

For any of the putter head described above, any of the features described below can be implemented.

A golf club can have a grip attached to a shaft and the shaft is attached to a putter head comprising a top portion, a sole portion opposite the top portion, a forward portion, a rearward portion opposite the forward portion, a heel portion, a toe portion opposite the heel portion, a face portion comprising a putter striking face that extends between the top portion and the sole portion. The striking face can have a geometric center defining an origin of a club head coordinate system when the putter head is at a normal address position. The club head coordinate system can include a club head X-axis being tangent to the striking face at the origin and parallel to a ground plane. The X-axis can extend in a positive direction from the origin to the heel portion of the putter head. The club head coordinate system can include a club head Y-axis intersecting the origin being parallel to the ground plane and orthogonal to the X-axis. The Y-axis can extend in a positive direction from the origin to the rearward portion of the putter head. The club head coordinate system can include a club head Z-axis intersecting the origin being orthogonal to both the X-axis and the Y-axis. The Z-axis can extend in a positive direction from the origin to the top portion of the putter head. The heel portion can extend towards, and include, a golf club shaft receiving portion, the heel portion extending from a Y-Z plane passing through the origin. The toe portion can be defined as the portion of the club head extending from the Y-Z plane in a direction opposite the heel portion. The putter head can include an electronic display for displaying one or more images. The electronic display can be visible to a user of the putter when the putter head is in the address position. The electronic display can include a memory, a microprocessor, and a battery. The electronic display can be configured to communicate with a user operable electronic device via a wired or a wireless communication protocol. The electronic display can be configured to receive one or more images from the user operable electronic device. The electronic display can be configured to store the one or more images in the memory. The electronic display can be configured to display the one or more images. The one or more images when displayed on the electronic display can include an alignment feature.

In certain examples, the electronic display can include an organic light-emitting diode (OLED) display, or a Thin Film Transistor (TFT) LCD display, or an active matrix organic light-emitting diode (AMOLED) display. In certain examples, the electronic display can include an e-ink display or e-paper display and the other display mentioned throughout the specification including the different types of led screens (transmissive, transflective, reflective).

In certain examples, the electronic display can be flexible. In certain examples, the electronic display can be curved. In certain examples, the electronic display can be curved in a heel to toe direction. In certain examples, the electronic display can be curved in a front to back direction. In certain examples, the electronic display can be curved about at least one axis. In certain examples, the electronic display can be curved about at least two or more axes. In any of the examples described herein, the golf club head can be a putter type golf club head.

In certain examples, the alignment feature can include a single straight line, two or more straight lines, at least one straight line and a circle, or a circle. In certain examples, the alignment feature can include multiple circles. In certain examples, the alignment feature can be configured to indicate a left or right tendency.

In certain examples, the user operable electronic device can be a computer, a cellular phone, a smart phone, a personal digital assistant (PDA) or a digital vending kiosk. In certain examples, the one or more images can be received via an internet website. In certain examples, the one or more images can include a video.

In certain examples, the wireless communication protocol can include Bluetooth™ Bluetooth LE, infrared datalink (IrDa), Wi-Fi, or ultra-wideband (UWB).

In certain examples, the electronic display can form at least a portion of an upper portion of the putter head.

In certain examples, the face portion further can include a recess and an insert secured within the recess, the insert defining at least a portion of the putter striking face.

In certain examples, the electronic display can be removably attachable to the putter head.

In certain examples, the battery is removably attachable to the putter head.

In certain examples, the electronic display can be removably attachable to the putter head and the battery can be a rechargeable type battery and capable of wired or wireless charging.

In certain examples, the battery can be removably attachable to the putter head, a rechargeable type battery, and capable of wired or wireless charging.

In certain examples, the battery can be removably attachable to the putter head and capable of replacement.

In certain examples, the battery can be sealed.

In certain examples, the electronic display can be sealed.

In certain examples, the electronic display can be sealed and include one or more buttons.

In certain examples, the one or more buttons can include a power button and a pairing button.

In certain examples, the power button and the pairing button can be the same button.

In certain examples, the electronic display can be sealed and be capable of wireless charging or magnetic charging.

In certain examples, the electronic display can be sealed and include a connector for charging that is sealed by a flexible door selectively operable by a user and include a gasket to prevent water intrusion.

In certain examples, the battery can be sealed and include a connector for charging that is sealed by a flexible door selectively operable by a user and include a gasket to prevent water intrusion.

In certain examples, the electronic display can extend from a forward end of the putter head to a rearward end of the putter head.

In certain examples, the electronic display can extend from a forward portion of the putter head proximate a face to top portion transition.

In certain examples, a portion of the electronic display can wrap from the top portion of the putter head towards the face portion of the putter creating a curved edge display.

In certain examples, a portion of the electronic display can wrap from the top portion of the putter head onto the face portion of the putter head and forms at least a portion of the putter head striking face.

In certain examples, the putter head can further include a second electronic display forming at least a portion of the putter head striking face.

In certain examples, the putter head can further include a second electronic display forming at least a portion of the top portion of the putter head.

In certain examples, a portion of the electronic display can be covered by the body and curve under and away from the body creating a gap between the electronic display and the body configured to prevent water pooling.

In certain examples, a portion of the electronic display can be covered by the body and curve under and away from the body creating a gap between the electronic display and the body configured to prevent water pooling. The electronic display can be covered on a heel side and a toe side of the electronic display such that the display is curved in a heel to toe direction.

In certain examples, the electronic display can curve at least in a front to back direction and a rear portion of the electronic display can be more proximate to a ground plane than a forward portion of the electronic display such that any water would tend to run off the rear portion of the electronic display.

In certain examples, the electronic display can be angled in at least in a front to back direction and a rear portion of the electronic display can be more proximate to a ground plane than a forward portion of the electronic display such that any water would tend to run off the rear portion of the electronic display.

In certain examples, the electronic display can curve at least in a front to back direction and the electronic display can have an apex located between a rear portion of the electronic display and a forward portion of the electronic display such that any water would tend to run off either the rear portion of the electronic display or the front portion of the electronic display. The apex can be closer to the forward portion of the electronic display than the rear portion of the electronic display.

In certain examples, the top portion of the putter head can include a recessed portion and the electronic display can at least partially sit within the recessed portion of the putter head body. The recessed portion can extend along a central region of the top portion of the putter head.

In certain examples, a thin metal frame can surround a perimeter of the electronic display.

In certain examples, the electronic display can have a minimum diagonal dimension of 1.8 inches.

In certain examples, the electronic display can have a width between 0.9 inches and 2.1 inches, or between 1.3 inches and 2.1 inches, or between 1.4 inches and 1.9 inches. In certain examples, the electronic display can have a length between 0.9 inches and 5.5 inches.

In certain examples, the electronic display can have a width that is at least 20% of a total width of the putter head as measured from a toeward-most point of the putter head to a heelward-most point of the putter head.

In certain examples, the electronic display can have a width that is between 20% and 75% of a total width of the putter head as measured from a toeward-most edge of the putter head to a heelward-most edge of the putter head.

In certain examples, the electronic display can have a width that is between 30% and 50% of a total width of the putter head as measured from a toeward-most edge of the putter head to a heelward-most edge of the putter head.

In certain examples, the electronic display can have a length that is between 30% and 100% of a total length of the putter head as measured from a forward-most edge of the putter head to a rearward-most edge of the putter head.

In certain examples, the electronic display can have a ppi (pixels per inch) no less than 100 ppi. In certain examples, the electronic display can have a ppi (pixels per inch) no less than 160 ppi. In certain examples, the electronic display can have a ppi (pixels per inch) no less than 250 ppi. In certain examples, the electronic display can have a ppi (pixels per inch) no less than 280 ppi.

In certain examples, the electronic display can include two or more displays.

In certain examples, the electronic display can include a first electronic display and a second electronic display, and the first and second electronic displays can have the same size and shape.

In certain examples, the electronic display can include a first electronic display and a second electronic display, and the first and second electronic displays can have different sizes and/or shapes.

In certain examples, the electronic display can include a first electronic display and a second electronic display, and the first and second electronic displays can have a circular shape and a diameter between 1.3 inches and 1.9 inches.

In certain examples, the electronic display can include a first electronic display and a second electronic display, and the first and second electronic displays can have a rectangular shape and a minor dimension between 1.3 inches and 1.9 inches.

In certain examples, the electronic display can include a first electronic display and a second electronic display, and the first and second electronic displays can have a square shape and an edge dimension between 1.3 inches and 1.9 inches.

Example Computing Systems

Figure 8:
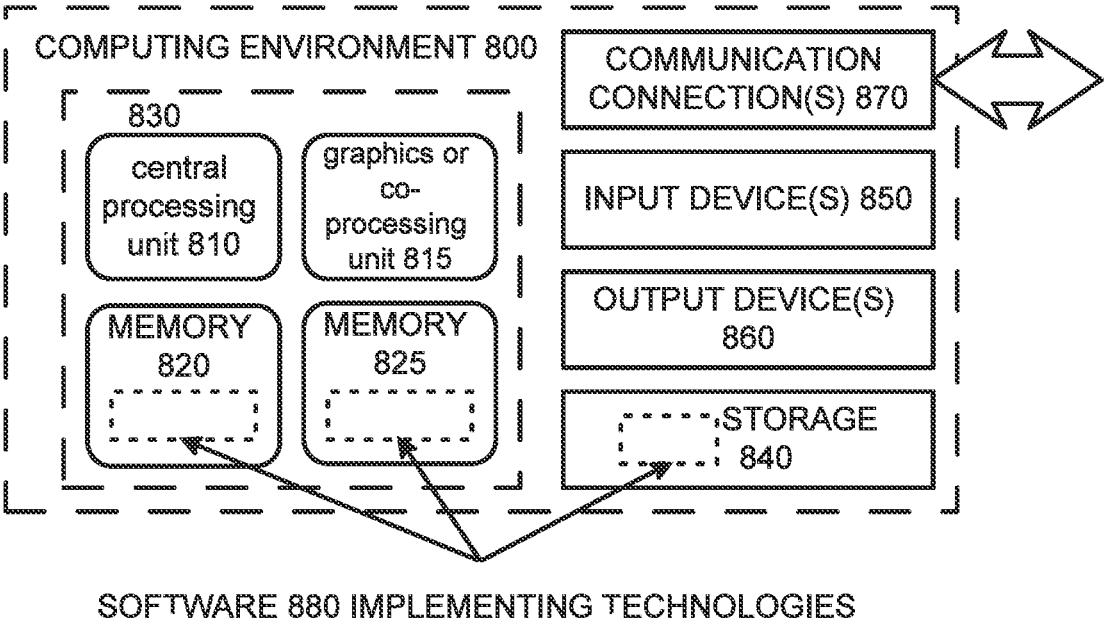
FIG. 8 is a block diagram of an example computing system in which described examples can be implemented.

FIG. 8 depicts an example of a suitable computing system 800 in which the described innovations can be implemented. The computing system 800 is not intended to suggest any limitation as to scope of use or functionality of the present disclosure, as the innovations can be implemented in diverse computing systems.

With reference to FIG. 8, the computing system 800 includes one or more processing units 810, 815 and memory 820, 825. In FIG. 8, this basic configuration 830 is included within a dashed line. The processing units 810, 815 execute computer-executable instructions, such as for implementing the features described in the examples herein. A processing unit can be a general-purpose central processing unit (CPU), processor in an application-specific integrated circuit (ASIC), or any other type of processor. In a multi-processing system, multiple processing units execute computer-executable instructions to increase processing power. For example, FIG. 8 shows a central processing unit 810 as well as a graphics processing unit or co-processing unit 815. The tangible memory 820, 825 can be volatile memory (e.g., registers, cache, RAM), nonvolatile memory (e.g., ROM, EEPROM, flash memory, etc.), or some combination of the two, accessible by the processing unit(s) 88, 815. The memory 820, 825 stores software 880 implementing one or more innovations described herein, in the form of computer-executable instructions suitable for execution by the processing unit(s) 810, 815.

A computing system 800 can have additional features. For example, the computing system 800 includes storage 840, one or more input devices 850, one or more output devices 860, and one or more communication connections 870, including input devices, output devices, and communication connections for interacting with a user. An interconnection mechanism (not shown) such as a bus, controller, or network interconnects the components of the computing system 800. Typically, operating system software (not shown) provides an operating environment for other software executing in the computing system 800, and coordinates activities of the components of the computing system 800.

The tangible storage 840 can be removable or non-removable, and includes magnetic disks, magnetic tapes or cassettes, CD-ROMs, DVDs, or any other medium which can be used to store information in a non-transitory way and which can be accessed within the computing system 800. The storage 840 stores instructions for the software implementing one or more innovations described herein.

The input device(s) 850 can be an input device such as a keyboard, mouse, pen, or trackball, a voice input device, a scanning device, touch device (e.g., touchpad, display, or the like) or another device that provides input to the computing system 800. The output device(s) 860 can be a display, printer, speaker, CD-writer, or another device that provides output from the computing system 800. For example, the input device(s) 850 can include the one or more sensors (e.g., the IMU) embedded within the putter head 100 or 200 described above, and the output device(s) 860 can include an electronic display 140 (or 240) described above.

The communication connection(s) 870 enable communication over a communication medium to another computing entity. The communication medium conveys information such as computer-executable instructions, audio or video input or output, or other data in a modulated data signal. A modulated data signal is a signal that has one or more of its characteristics set or changed in such a manner as to encode information in the signal. By way of example, and not limitation, communication media can use an electrical, optical, RF, or other carrier. In one specific example, the communication connection(s) 870 can include a communication unit (e.g., the Bluetooth module) of the electronic assembly 104 (or 204) described above which is configured to wirelessly communicate with the mobile computing device 150.

The innovations can be described in the context of computer-executable instructions, such as those included in program modules, being executed in a computing system on a target real or virtual processor (e.g., which is ultimately executed on one or more hardware processors).

Generally, program modules or components include routines, programs, libraries, objects, classes, components, data structures, etc. that perform particular tasks or implement particular abstract data types. The functionality of the program modules can be combined or split between program modules as desired in various examples. Computer-executable instructions for program modules can be executed within a local or distributed computing system.

For the sake of presentation, the detailed description uses terms like "determine" and "use" to describe computer operations in a computing system. These terms are high-level descriptions for operations performed by a computer, and should not be confused with acts performed by a human being. The actual computer operations corresponding to these terms vary depending on implementation.

Computer-Readable Media

Any of the computer-readable media herein can be non-transitory (e.g., volatile memory such as DRAM or SRAM, nonvolatile memory such as magnetic storage, optical storage, or the like) and/or tangible. Any of the storing actions described herein can be implemented by storing in one or more computer-readable media (e.g., computer-readable storage media or other tangible media). Any of the things (e.g., data created and used during implementation) described as stored can be stored in one or more computer-readable media (e.g., computer-readable storage media or other tangible media). Computer-readable media can be limited to implementations not consisting of a signal.

Any of the methods described herein can be implemented by computer-executable instructions in (e.g., stored on, encoded on, or the like) one or more computer-readable media (e.g., computer-readable storage media or other tangible media) or one or more computer-readable storage devices (e.g., memory, magnetic storage, optical storage, or the like). Such instructions can cause a computing device to perform the method. The technologies described herein can be implemented in a variety of programming languages.

Example Cloud Computing Environment

Figure 9:
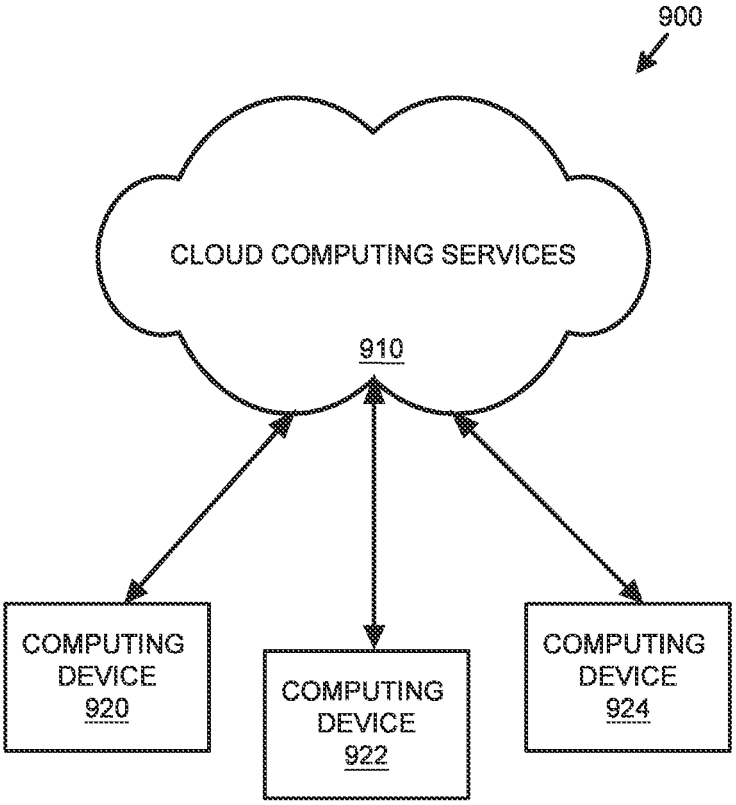
FIG. 9 is a block diagram of an example cloud computing environment that can be used in conjunction with the technologies described herein.

FIG. 9 depicts an example cloud computing environment 900 in which the described technologies can be implemented, including, e.g., the system disclosed above and other systems herein. The cloud computing environment 900 comprises cloud computing services 910. The cloud computing services 910 can comprise various types of cloud computing resources, such as computer servers, data storage repositories, networking resources, etc. The cloud computing services 910 can be centrally located (e.g., provided by a data center of a business or organization) or distributed (e.g., provided by various computing resources located at different locations, such as different data centers and/or located in different cities or countries).

The cloud computing services 910 are utilized by various types of computing devices (e.g., client computing devices), such as computing devices 920, 922, and 923. For example, the computing devices (e.g., 920, 922, and 924) can be computers (e.g., desktop or laptop computers), mobile devices (e.g., tablet computers or smart phones), or other types of computing devices. For example, the computing devices (e.g., 920, 922, and 924) can utilize the cloud computing services 910 to perform computing operations (e.g., data processing, data storage, and the like).

In practice, cloud-based, on-premises-based, or hybrid scenarios can be supported.

Example Implementations

Although the operations of some of the disclosed methods are described in a particular, sequential order for convenient presentation, such manner of description encompasses rearrangement, unless a particular ordering is required by specific language set forth herein. For example, operations described sequentially can in some cases be rearranged or performed concurrently.

Example Embodiments

Any of the following example embodiments can be implemented.

Embodiment 1. A putter head comprising: a body; and an electronic assembly integrated with the body, wherein the electronic assembly comprises an electronic display viewable from above the body and a controller in electrical communication with the electronic display, wherein the controller is configured to select an alignment feature from a plurality of alignment features and display the selected alignment feature on the electronic display, wherein the displayed alignment feature extends from a front part of the electronic display toward a rear part of the electronic display.

Embodiment 2. The putter head of embodiment 1, further comprising one or more sensors coupled to the body portion and in electrical communication with the controller, wherein an angle of the displayed alignment feature relative to a striking face of the putter head is determined at least partially by data measured by the one or more sensors.

Embodiment 3. The putter head of embodiment 1, wherein an angle of the displayed alignment feature relative to a striking face of the putter head is determined based on data wirelessly received from a mobile computing device.

Embodiment 4. The putter head of embodiment 1, wherein the electronic assembly further comprises a communication unit in electrical communication with the controller, wherein the controller is configured to wirelessly receive data from a mobile computing device through the communication unit.

Embodiment 5. The putter head of embodiment 4, further comprises a switch in electrical communication with the controller, wherein operation of the switch is configured to turn ON or OFF of the electronic display and pairing between the communication unit and the mobile computing device.

Embodiment 6. The putter head of embodiment 1, wherein the electronic assembly is hermetically sealed within the body.

Embodiment 7. The putter head of embodiment 1, wherein the body comprises a lens covering at least a portion of the electronic display, wherein the lens is transparent and has a curved top surface.

Embodiment 8. The putter head of embodiment 7, wherein the electronic display comprises an emissive display, wherein the lens comprises an antireflective coating.

Embodiment 9. The putter head of embodiment 7, wherein the electronic display comprises a reflective display.

Embodiment 10. The putter head of embodiment 1, wherein the body and the electronic assembly are fixedly coupled together to form a unitary piece such that the electronic assembly is non-removable from the body without breaking the body.

Embodiment 11. The putter head of embodiment 1, wherein the electronic assembly comprises a battery in electrical communication with the electronic display and the controller, and a receiving coil configured to align with a transmitting coil of an external charging device, wherein the battery is configured to be wirelessly charged through electromagnetic coupling between the receiving coil and the transmitting coil.

Embodiment 12. A system comprising: a putter head comprising a communication unit; and a mobile computing device configured to wireless communicate with the communication unit of the putter head, wherein the putter head further comprises: a body; an electronic display disposed over a top portion of the body; and a controller in electrical communication with the electronic display and the communication unit, wherein the controller is configured to receive data from the mobile computing device through the communication unit, and display an alignment feature on the electronic display based on the data received from the mobile computing device.

Embodiment 13. The system of embodiment 12, wherein the alignment feature comprises at least one sight line extending from a front part of the electronic display toward a rear part of the electronic display, wherein an angle of the at least one sight line relative to a striking face of the putter head is adjustable based on the data received from the mobile computing device.

Embodiment 14. The system of embodiment 12, wherein the alignment feature comprises a plurality of parallel sight lines extending from a front part of the electronic display toward a rear part of the electronic display.

Embodiment 15. The system of embodiment 12, wherein the alignment feature comprises a plurality of circles arranged in a line extending from a front part of the electronic display toward a rear part of the electronic display.

Embodiment 16. The system of embodiment 12, wherein the alignment feature is one of a plurality of alignment features selectable by a user of the mobile computing device.

Embodiment 17. The system of embodiment 12, further comprising a head cover configured to receive the putter head, wherein the head cover is configured to wirelessly charge a battery of the putter head.

Embodiment 18. A method comprising: pairing a putter head with a mobile computing device to establish a wireless communication between the putter head and the mobile computing device; selecting a first alignment feature from a user interface of the mobile computing device; transmitting the first alignment feature to the putter head; and displaying the first alignment feature on an electronic display of the putter head.

Embodiment 19. The method of embodiment 18, further comprising: selecting a second alignment feature that is different from the first alignment feature from the user interface of the mobile computing device; transmitting the second alignment feature to the putter head; and displaying the second alignment feature on an electronic display of the putter head.

Embodiment 20. The method of embodiment 18, further comprising measuring putting parameters by one or more sensors embedded in the putter head, transmitting the putting parameters to the mobile device, and presenting the putting parameters or statistics of the putting parameters through the user interface of the mobile computing device.

Embodiment 21. A putter head comprising: a body; an electronic assembly attached to the body, wherein the electronic assembly comprises: a housing, an electronic display viewable from above the body, a communication unit configured to wirelessly communicate with a mobile communication device, and a controller in electrical communication with the electronic display and the communication unit, wherein the controller is configured to receive data from the mobile computing device through the communication unit, and display an alignment feature on the electronic display based on the data received from the mobile computing device, wherein a mass of the electronic assembly is between 8% and 16% of a total weight of the putter head including the electronic assembly.

Embodiment 22. The putter head of embodiment 21, wherein the mass of the electronic assembly divided by a water displaced volume of the electronic assembly is between 0.25 $g/cm^3$ and 1.75 $g/cm^3$.

Embodiment 23. The putter head of embodiment 22, wherein a moment of inertia of the putter head about at least one axis passing through a center of gravity of the putter head is between 4,000 $g \cdot cm^2$ and 10,000 $g \cdot cm^2$.

Embodiment 24. The putter head of embodiment 23, wherein the electronic assembly is at least partially sealed and has an Ingress Protection rating (IPXX) between IP54 and IP68 or IP69.

Embodiment 25. The putter head of embodiment 23, wherein the electronic display is angled in a front-to-back direction such that a first elevation at a forward portion of the electronic display is greater than a second elevation at a rearward portion of the electronic display as measured relative to a ground plane when the putter head is in a normal address position.

Embodiment 26. The putter head of embodiment 23, wherein the electronic assembly further comprises a battery located within the housing, wherein the battery has a charge capacity between 25 mAh and 620 mAh, and a total mass between 1 gram and 15 grams.

Embodiment 27. The putter head of embodiment 26, wherein a bottom portion of the electronic assembly extends into a cavity formed in the body of the putter head.

Embodiment 28. The putter head of embodiment 26, wherein a bottom portion of the electronic assembly extends into a cavity formed in the body of the putter head, wherein the bottom portion of the electronic assembly is shaped to match a shape of the cavity.

Embodiment 29. The putter head of embodiment 26, wherein a bottom portion of the electronic assembly extends into a cavity formed in the body of the putter head, wherein the electronic assembly nestably sits within the cavity.

Embodiment 30. The putter head of embodiment 28, wherein the cavity formed in the body of the putter head has a bottom opening, wherein an area of the bottom opening ranges between 400 $mm^2$ to 2,500 $mm^2$.

Embodiment 31. The putter head of embodiment 30, wherein the area of the bottom opening ranges between 900 $mm^2$ to 1,800 $mm^2$.

Embodiment 32. The putter head of embodiment 30, wherein a top portion of the electronic assembly extends overtop an upper portion of the body and proximate a striking face of the body.

Embodiment 33. The putter head of embodiment 30, wherein a top portion of the electronic assembly defines an uppermost portion of the putter head excluding a hosel of the putter head and forms and uppermost portion of a striking face of the body.

Embodiment 34. The putter head of embodiment 30, wherein the body and the electronic assembly are fixedly coupled together to form a unitary piece such that the electronic assembly is non-removable from the body without breaking the body.

Embodiment 35. The putter head of embodiment 21, wherein the electronic display is a segmented display comprising a plurality of line segments that are configured to be independently turned ON or OFF.

RELATED APPLICATIONS

More information related to putters and other golf clubs and golf club heads can be found in the following, which are all incorporated by reference herein in their entirety:

U.S. Pat. No. 11,179,608
U.S. Pat. No. 10,874,928
U.S. Pat. No. 10,391,369
U.S. Pat. No. 10,052,530
U.S. Pat. No. 9,827,479
U.S. Pat. No. 9,522,313
U.S. Pat. No. 9,468,817
U.S. Pat. No. 9,375,619
U.S. Pat. No. 9,220,960
U.S. Pat. No. 8,328,654
U.S. Pat. No. 8,066,581
U.S. Pat. No. 7,648,425
U.S. Pat. No. 7,594,865
U.S. Pat. No. 7,465,240
U.S. Pat. No. 7,438,648
U.S. Pat. No. 7,396,295
U.S. Pat. No. 7,278,926
U.S. Pat. No. 6,929,564

In view of the many possible embodiments to which the principles of the disclosure may be applied, it should be recognized that the illustrated embodiments are only preferred examples and should not be taken as limiting the scope of the disclosure. Various modifications may be made thereto without departing from the broader spirit and scope of the disclosure as set forth. The specification and drawings are, accordingly, to be regarded in an illustrative sense rather than a restrictive sense. Accordingly, the scope of the disclosure is at least as broad as the full scope of the following exemplary claims and their equivalents.

What is claimed is:

1. A putter head comprising:
a body; and
an electronic assembly attached to the body,
wherein the electronic assembly comprises:
a housing;
an electronic display viewable from a location external to the body;
a communication unit configured to receive and transmit wireless communication signals; and
a controller in electrical communication with the electronic display and the communication unit,
wherein the controller is configured to display an alignment feature on the electronic display at least partially in response to one or more of the wireless communication signals received by the communication unit, and
wherein a mass of the electronic assembly is between, and inclusive of, 8% and 16% of a total weight of the putter head,
wherein the mass of the electronic assembly divided by a water displaced volume of the electronic assembly is between, and inclusive of, 0.25 $g/cm^3$ and 1.75 $g/cm^3$.

2. The putter head of claim 1, wherein a moment of inertia of the putter head about at least one axis passing through a center of gravity of the putter head is between, and inclusive of, 4,000 $g \cdot cm^2$ and 10,000 $g \cdot cm^2$.

3. The putter head of claim 2, wherein the electronic assembly is at least partially sealed and has an Ingress Protection rating (IPXX) between, and inclusive of, IP54 and IP69.

4. The putter head of claim 2, wherein the electronic display is sloped in a forward-to-rearward direction such that a first elevation at a forward portion of the electronic display, is greater than a second elevation at a rearward portion of the electronic display, as measured relative to a ground plane when the putter head is in a normal address position on the ground plane.

5. The putter head of claim 2, wherein the electronic assembly further comprises a battery located within the housing, and wherein the battery has a charge capacity between, and inclusive of, 25 mAh and 620 mAh, and a total mass between, and inclusive of, 1 gram and 15 grams.

6. The putter head of claim 5, wherein the body comprises an internal cavity, the electronic assembly comprises a bottom portion, and the bottom portion of the electronic assembly extends into the internal cavity of the body.

7. The putter head of claim 5, wherein the body comprises an internal cavity, the electronic assembly comprises a bottom portion, and the bottom portion of the electronic assembly extends into the internal cavity of the body, and wherein the bottom portion of the electronic assembly is shaped to match a shape of the cavity.

8. The putter head of claim 5, wherein the body comprises an internal cavity, the electronic assembly comprises a bottom portion, and the bottom portion of the electronic assembly extends into the internal cavity of the body, and wherein the electronic assembly nestably sits within the internal cavity.

9. The putter head of claim 7, wherein the internal cavity of the body of has a bottom opening, and wherein an area of the bottom opening is between, and inclusive of, 400 $mm^2$ and 2,500 $mm^2$.

10. The putter head of claim 9, wherein the area of the bottom opening is between, and inclusive of, 900 $mm^2$ to 1,800 $mm^2$.

11. The putter head of claim 9, wherein the body comprises a striking face, the electronic assembly comprises a top portion, the body comprises an upper portion, and the top portion of the electronic assembly extends overtop and is adhered to the upper portion of the body, and wherein the upper portion of the body is proximate the striking face of the body.

12. The putter head of claim 9, further comprising a hosel, wherein the body comprises a striking face having an uppermost portion, the electronic assembly comprises a top portion, which defines an uppermost portion of the putter head excluding the hosel and forms the uppermost portion of the striking face of the body.

13. The putter head of claim 9, wherein the body and the electronic assembly are fixedly coupled together such that the electronic assembly is non-removable from the body without breaking the body or the electronic assembly.

14. The putter head of claim 6, wherein the electronic display is a segmented display comprising a plurality of line segments that are configured to be independently turned ON or OFF.

15. The putter head of claim 6, wherein the alignment feature is one of a first alignment feature, a second alignment feature, or a third alignment feature, and wherein the controller is configured to selectively switch between display of the first alignment feature, the second alignment feature, and the third alignment feature on the electronic display.

16. The putter head of claim 15, wherein the putter head has a center-of-gravity (CG) and a Zup distance is defined as a vertical distance from a ground plane to the CG, as measured along a vertical Z-axis when the putter head is positioned in a normal address position on the ground plane, wherein the battery has a battery center-of-gravity (CGb) and a battery Zup distance (Zup-b), defined as a vertical distance from the ground plane to the CGb, as measured along the vertical Z-axis when the putter head is positioned in the normal address position on the ground plane, and wherein Zup is greater than Zup-b.

17. The putter head of claim 16, wherein the communication unit comprises an antenna, which has an antenna center-of-gravity (CGa) defining a CGa X-axis extending along a width of the putter head in a heel to toe direction and parallel to the ground plane, a CGa Z-axis parallel to the Z-axis, and a CGa Y-axis extending along a length of the putter head in a front to back direction and perpendicular to the X-axis and the Z-axis, and wherein the CGa is at least 3 mm from any portion of the body having a density greater than 5.0 $g/cm^3$.

18. The putter head of claim 17, wherein the CGa X-axis intersects no portion of the body having a density greater than 5.0 $g/cm^3$.

19. The putter head of claim 17, wherein the CG of the putter head is located a CGy distance, along the Y-axis, from a geometric center of a striking face of the body, wherein the CGy distance is at least 35% of a front-to-rear length of the putter head, wherein the CGb is located a CGby distance from the geometric center, and wherein CGby is greater than CGy.

20. The putter head of claim 17, wherein the CGb is located toeward of the CG of the putter head.

21. The putter head of claim 20, wherein the battery has a battery length of at least 40% of an overall head length, a battery width of at least 25% of an overall head width, and a battery depth of no more than 50% of Zup and no less than 3% of Zup.

22. The putter head of claim 17, wherein a portion of the antenna is located toeward of the CG of the putter head.

23. The putter head of claim 17, further comprises a lens that comprises one or more ribs along a perimeter of the lens, wherein the one or more ribs are configured to mate with a groove on the housing and the one or more ribs are adhered to the housing.

24. The putter head of claim 17, wherein the electronic assembly further comprises one or more double-sided adhesives for sealing one or more openings in the housing or one or more openings in a top portion of the putter head.

25. The putter head of claim 6, further comprising a first double-sided adhesive which is sandwiched between the housing and a button operatively coupled to a printed circuit board electronic assembly.

26. The putter head of claim 25, further comprising a lens and a second double-sided adhesive which is sandwiched between the lens and a cap in a top portion of the putter head.

27. The putter head of claim 26, wherein the first double-sided adhesive and the second double-sided adhesive are configured to prevent water ingress such that the electronic assembly is at least partially sealed and has an Ingress Protection rating (IPXX) between, and inclusive of, IP54 and IP69.

28. The putter head of claim 17, wherein the antenna has a Zup-a and the Zup-a is greater than the Zup-b of the battery.

29. The putter head of claim 17, wherein the antenna has a Zup-a and the Zup-a is greater than the Zup of the putter head.

30. The putter head of claim 1, wherein the electronic assembly further comprises a battery, and wherein the battery has a total mass between, and inclusive of, 1 gram and 15 grams;

wherein the putter head has a center-of-gravity (CG) and a Zup distance is defined as a vertical distance from a ground plane to the CG, as measured along a vertical Z-axis when the putter head is positioned in a normal address position on the ground plane, wherein the battery has a battery center-of-gravity (CGb) and a battery Zup distance (Zup-b), defined as a vertical distance from the ground plane to the CGb, as measured along the vertical Z-axis when the putter head is positioned in the normal address position on the ground plane, and wherein Zup is greater than Zup-b.

31. The putter head of claim 30, wherein the communication unit comprises an antenna, which has an antenna center-of-gravity (CGa) defining a CGa X-axis extending along a width of the putter head in a heel to toe direction and parallel to the ground plane, a CGa Z-axis parallel to the Z-axis, and a CGa Y-axis extending along a length of the putter head in a front to back direction and perpendicular to the X-axis and the Z-axis, and wherein the CGa is at least 3 mm from any portion of the body having a density greater than 5.0 $g/cm^3$.

32. The putter head of claim 31, wherein the CG of the putter head is located a CGy distance, along the Y-axis, from a geometric center of a striking face of the body, wherein the CGy distance is at least 35% of a front-to-rear length of the putter head, wherein the CGb is located a CGby distance from the geometric center, and wherein CGby is greater than CGy.

33. The putter head of claim 31, wherein the CGb is located toeward of the CG of the putter head.

34. The putter head of claim 33, wherein the battery has a battery length of at least 40% of an overall head length, a battery width of at least 25% of an overall head width, and a battery depth of no more than 50% of Zup and no less than 3% of Zup.

35. The putter head of claim 31, wherein a portion of the antenna is located toeward of the CG of the putter head.

36. The putter head of claim 31, wherein the antenna has a Zup-a and the Zup-a is greater than the Zup-b of the battery.

37. The putter head of claim 31, wherein the antenna has a Zup-a and the Zup-a is greater than the Zup of the putter head.

38. The putter head of claim 1, wherein the putter head has a center-of-gravity (CG) and a Zup distance is defined as a vertical distance from a ground plane to the CG, as measured along a vertical Z-axis when the putter head is positioned in a normal address position on the ground plane;

wherein the communication unit comprises an antenna, which has an antenna center-of-gravity (CGa) defining a CGa X-axis extending along a width of the putter head in a heel to toe direction and parallel to the ground plane, a CGa Z-axis parallel to the Z-axis, and a CGa Y-axis extending along a length of the putter head in a front to back direction and perpendicular to the X-axis and the Z-axis, and wherein the CGa is at least 3 mm from any portion of the body having a density greater than 5.0 g/cm$^3$.

39. The putter head of claim 38, wherein the antenna has a Zup-a and the Zup-a is greater than the Zup of the putter head.

* * * * *